US006334035B1

(12) United States Patent
Abe et al.

(10) Patent No.: US 6,334,035 B1
(45) Date of Patent: Dec. 25, 2001

(54) DEVELOPER CONTAINER AND CARTRIDGE

(75) Inventors: Daisuke Abe, Shizuoka-ken; Tadayuki Tsuda, Susono; Yoshiyuki Batori; Takao Nakagawa, both of Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/505,688

(22) Filed: Feb. 17, 2000

(30) Foreign Application Priority Data

| | | |
|---|---|---|
| Feb. 18, 1999 | (JP) | 11-039620 |
| Feb. 18, 1999 | (JP) | 11-039622 |
| May 18, 1999 | (JP) | 11-136878 |
| Feb. 15, 2000 | (JP) | 2000-036993 |

(51) Int. Cl.[7] ..... G03G 15/00; G03G 15/08
(52) U.S. Cl. ..... 399/106; 399/111
(58) Field of Search ..... 399/106, 103, 399/102, 262, 258; 222/DIG. 1

(56) References Cited

U.S. PATENT DOCUMENTS

| | | | |
|---|---|---|---|
| 5,126,800 | 6/1992 | Shishido et al. | 399/111 |
| 5,151,734 | 9/1992 | Tsuda et al. | 399/111 |
| 5,208,634 | 5/1993 | Ikemoto et al. | 399/111 |
| 5,223,893 | 6/1993 | Ikemoto et al. | 399/111 |
| 5,294,960 | 3/1994 | Nomura et al. | 399/113 |
| 5,331,372 | 7/1994 | Tsuda et al. | 399/114 |
| 5,345,294 | 9/1994 | Nomura et al. | 399/90 |
| 5,404,198 | 4/1995 | Noda et al. | 399/107 |
| 5,470,635 | 11/1995 | Shirai et al. | 428/131 |
| 5,475,470 | 12/1995 | Sasago et al. | 399/111 |
| 5,488,459 | 1/1996 | Tsuda et al. | 399/167 |
| 5,510,878 | 4/1996 | Noda et al. | 399/111 |
| 5,561,504 | 10/1996 | Watanabe et al. | 399/111 |
| 5,581,325 | 12/1996 | Tsuda et al. | 399/116 |
| 5,583,613 | 12/1996 | Kobayashi et al. | 399/111 |
| 5,602,623 | 2/1997 | Nishibata et al. | 399/111 |
| 5,608,509 | 3/1997 | Shirai et al. | 399/351 |
| 5,621,507 * | 4/1997 | Nishimura et al. | 399/111 |
| 5,623,328 | 4/1997 | Tsuda et al. | 399/111 |
| 5,659,847 | 8/1997 | Tsuda et al | 399/113 |
| 5,669,042 | 9/1997 | Kobayashi et al. | 399/111 |
| 5,768,660 | 6/1998 | Kurihara et al. | 399/111 |
| 5,809,374 | 9/1998 | Tsuda et al. | 399/111 |
| 5,812,909 | 9/1998 | Oguma et al. | 399/103 |
| 5,828,928 | 10/1998 | Sasago et al. | 399/111 |
| 5,878,304 | 3/1999 | Watanabe et al. | 399/92 |
| 5,911,096 | 6/1999 | Batori et al. | 399/111 |
| 5,920,753 | 6/1999 | Sasaki et al. | 399/111 |
| 5,923,918 | 7/1999 | Nakagawa et al. | 399/27 |
| 5,930,562 | 7/1999 | Noda et al. | 399/114 |
| 5,937,237 | 8/1999 | Nonaka et al. | 399/106 |
| 5,940,658 | 8/1999 | Yokoi | 399/119 |
| 6,006,058 | 12/1999 | Watanabe et al. | 399/167 |
| 6,011,941 | 1/2000 | Takashima et al. | 399/111 |
| 6,041,196 | 3/2000 | Nakagawa et al. | 399/27 |
| 6,058,278 * | 5/2000 | Tsuda et al. | 399/106 |
| 6,122,458 * | 9/2000 | Kita et al. | 399/106 X |

FOREIGN PATENT DOCUMENTS

| | | |
|---|---|---|
| 62-127876 | 6/1987 | (JP) . |
| 62-110954 U | 7/1987 | (JP) . |
| 1-193872 | 8/1989 | (JP) . |

* cited by examiner

*Primary Examiner*—Sophia S. Chen
(74) *Attorney, Agent, or Firm*—Fitzpatrick, Cella, Harper & Scinto

(57) ABSTRACT

A developer container which has a container main body includes an opening through which a developer is supplied, a seal member for unsealably sealing the opening, and a drive source for applying a force for unsealing the seal member. The drive source has an elastic member and the drive source applies the unsealing force using a restoring force of the elastic member.

48 Claims, 23 Drawing Sheets

DEVELOPER CONTAINER AND CARTRIDGE

BACKGROUND OF THE INVENTION

1. Field of the Invention

The present invention relates to a developer container for use in an image forming apparatus such as an electrophotographic apparatus, and a cartridge detachably attachable to the image forming apparatus.

Examples of image forming apparatuses include electrophotographic copiers, electrophotographic printers (for example, laser printers and LED printers or the like), facsimile terminal equipment, and word processors or the like.

In addition, as cartridges for image forming apparatuses, for example, process cartridges are used. The process cartridge comprises at least one of charging means and cleaning means, an electrophotographic photosensitive member that is an image bearing member (bearer), and developing means, which are integrated as a cartridge and are detachably attachable to an image-forming-apparatus main body. Alternatively, the process cartridge comprises at least developing means and an electrophotographic photosensitive member, which are integrated as a cartridge and are detachably attachable to an image-forming-apparatus main body.

In addition, a developing apparatus contains (houses) a developer for developing an electrostatic image formed on an electrophotographic photosensitive member and uses developing means to develop the electrostatic image with the developer in order to visualize the image.

2. Related Background Art

Conventional electrophotographic image forming apparatuses using an electrophotographic-image-forming process are based on a process-cartridge method for integrating an electrophotographic photosensitive member and process means acting on the electrophotographic photosensitive member, together as a cartridge and detachably attaching this cartridge to an image-forming-apparatus main body. This process-cartridge method enables users to carry out maintenance work for the apparatus without relying on service personnel, thereby substantially improving operability. Thus, the process-cartridge method is commonly used in image forming apparatuses.

In such a process cartridge, a toner container that is a developer container configuring part of a developing apparatus has an opening for supplying a developing-container side with a toner (a developer) contained in the toner container. This opening is sealed with a toner seal that is a seal member while the process cartridge is unused. When the process cartridge is used, a folded-back portion of the toner seal is unsealed by pulling the seal in the folding-back direction, thereby enabling the toner to be supplied to the developing-container side from the toner container.

In order to automatically unseal the toner seal, automatic unsealing mechanisms have been proposed that automatically unseal the toner seal by winding up the folded-back portion of the toner seal around a winding member, such as a winding shaft, via an operational force applied upon installation of the process cartridge in the image-forming-apparatus main body or via a power-transmission device, such as a gear, which is driven by a motor upon the installation of the process cartridge in the image-forming-apparatus main body (Japanese Patent Application Laid-Open No. 1-193872, Japanese Utility Model Application Laid-Open No. 62-110954, Japanese Patent Application Laid-Open No. 62-127876, etc.).

Thus, a simple inexpensive configuration has been desired as a mechanism for automatically unsealing the toner seal member.

SUMMARY OF THE INVENTION

It is an object of the present invention to provide a developer container and a cartridge that enable a seal member to be automatically unsealed using a simple configuration.

Other objects and features of the present invention will be apparent from the following detailed description taken in connection with the accompanying drawings.

DETAILED DESCRIPTION OF THE PREFERRED EMBODIMENTS

Embodiments of the present invention will be described below in detail with reference to the drawings.

In the embodiments, a laser beam printer is explained as an embodiment of an electrophotographic image forming apparatus.

Figure 1:
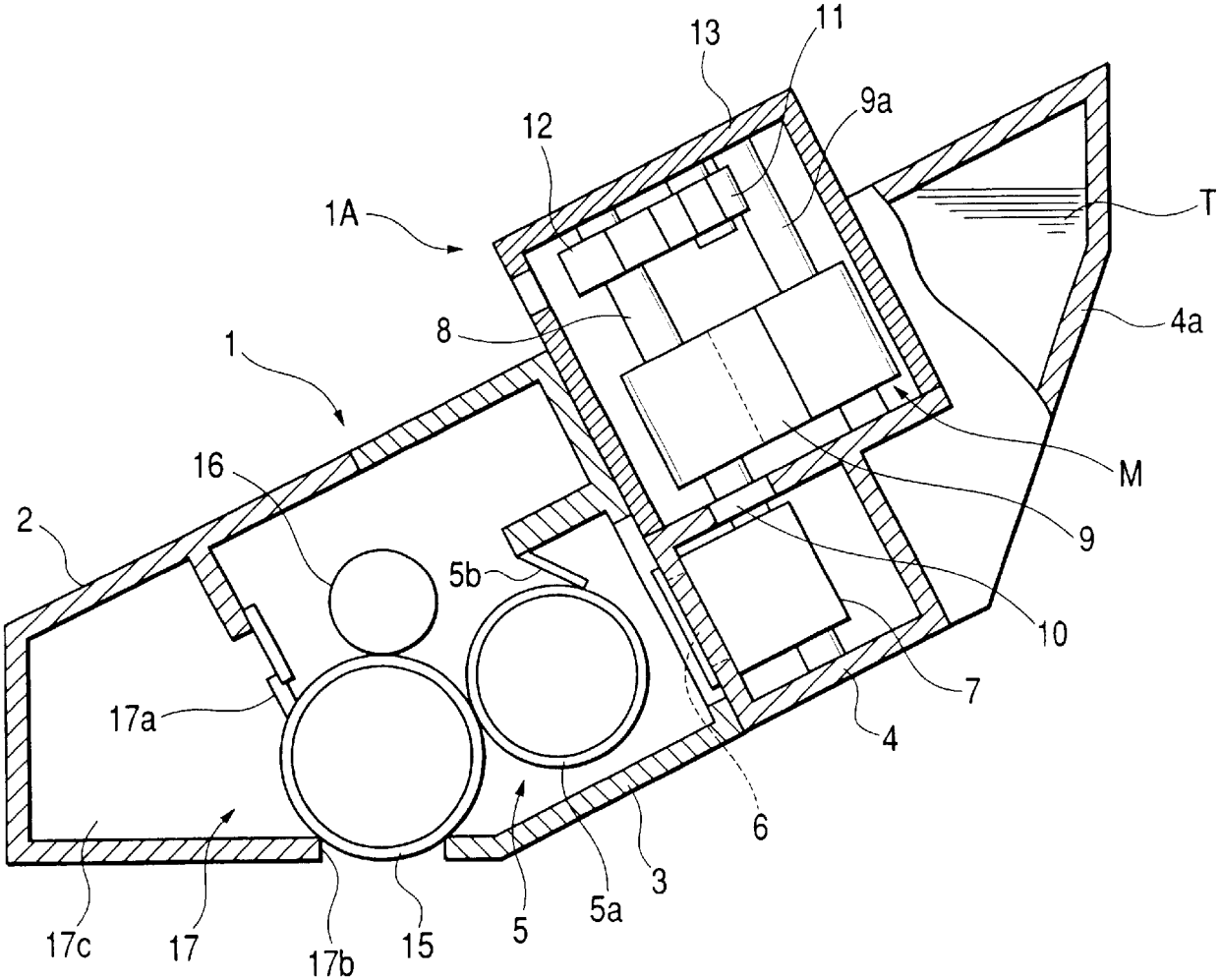
FIG. 1 is a typical explanatory drawing of a configuration of a process cartridge.
Figure 5:
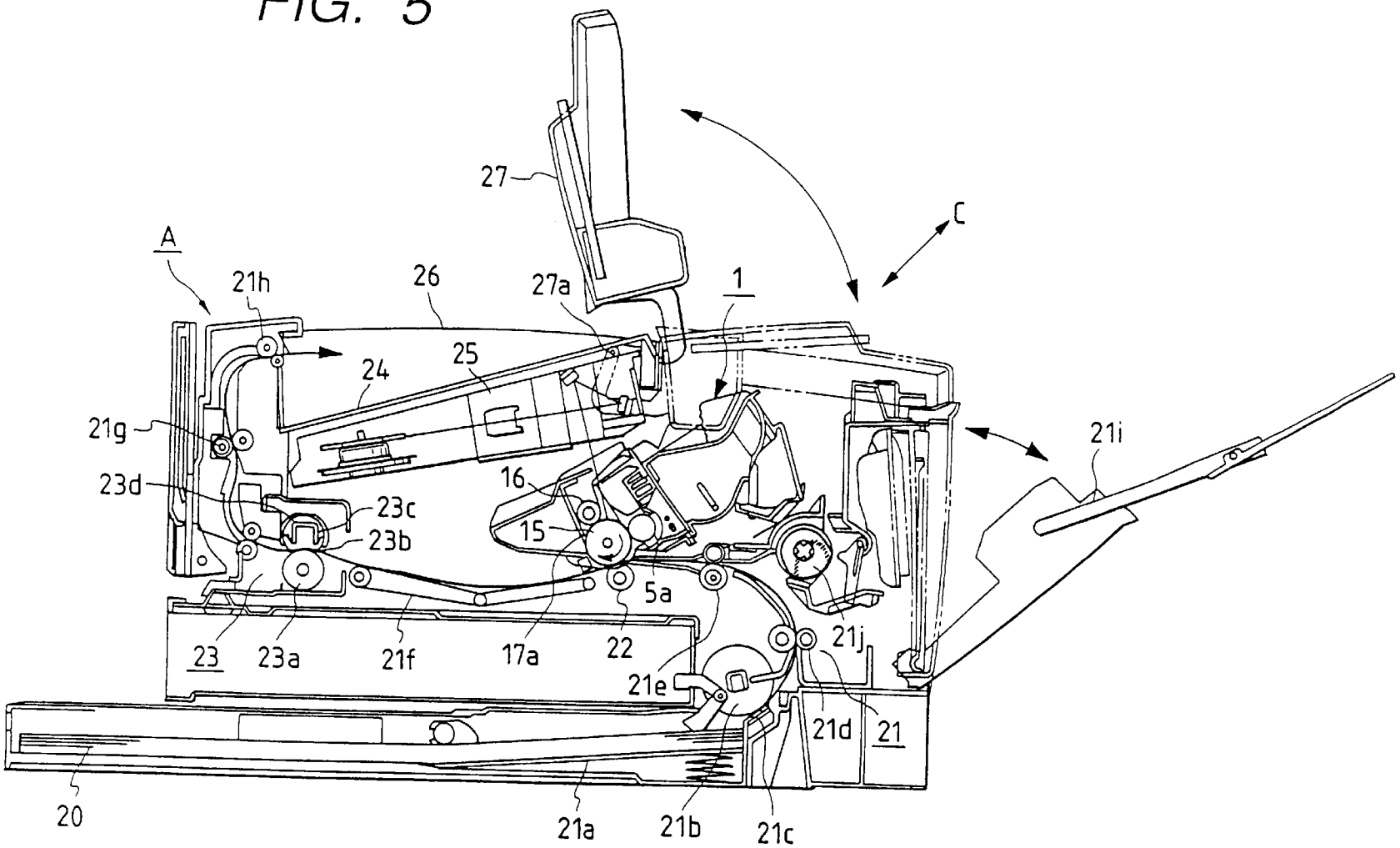
FIG. 5 is a typical explanatory drawing of an electrophotographic image forming apparatus with the process cartridge installed therein.

First, a process cartridge and an electrophotographic image forming apparatus that allows the process cartridge to be installed therein will specifically be described with reference to FIGS. 1 and 5. FIG. 1 is a typical explanatory drawing of a configuration of a process cartridge. FIG. 5 is a typical explanatory drawing of a configuration of an electrophotographic image forming apparatus with the process cartridge installed therein.

In the course of the following description, the general configuration of the electrophotographic image forming apparatus is first explained and the configuration of the process cartridge is then explained.

(General Configuration)

As shown in FIG. 5, an electrophotographic image forming apparatus (a laser beam printer) A irradiates an electrophotographic photosensitive member 15 that is a drum-shaped image bearer (hereafter referred to as a "photosensitive member drum") with information light based on image information from optics 25, in order to form an electrostatic latent image on the photosensitive-member drum 15. The electrophotographic image forming apparatus then develops this electrostatic latent image with a developer (hereafter referred to as a "toner") to form a toner image. In synchronism with the formation of the toner image, recording media (recording materials, OHP sheets, cloths, etc.) are separated and fed one by one from a cassette 21*a* accommodating them, using a pickup roller 21*b* and a pressure contact member 21*c* that is in pressure contact therewith. The recording medium 20 is conveyed by a convey means 21, consisting of a pair of convey rollers 21*d*, a pair of registration rollers 21*e*, and other components, and the toner image formed on the photosensitive-member drum 15, which is integrated into a cartridge as a process cartridge B, is applied under voltage to a transfer roller 22 that is transfer means, whereby the image is transferred to the recording medium 20. The recording medium 20 is then conveyed to fixing means 23 by means of a convey belt 21*f*. The fixing means 23 consists of a drive roller 23*a* and a fixing roller 23*d* comprised of a cylindrical sheet that incorporates a heater 23*b* and that is rotatably supported by a support 23*c*. The fixing means 23 applies heat and pressure to the passing recording medium 20 to fix the transferred toner image thereto. The recording medium 20 is then conveyed by a pair of discharging rollers 21*g*, 21*h* and discharged to a discharge portion 24 through a turnover convey path. The image forming apparatus A enables manual feeding using a manual-feeding tray 21*i* and a roller 21*j*.

(Process Cartridge)

On the other hand, the process cartridge 1 comprises an electrophotographic photosensitive member and at least one process means. The process means may be, for example, charging means for charging the electrophotographic photosensitive member, developing means for developing an electrostatic latent image formed on the electrophotographic photosensitive member, or cleaning means for removing a toner remaining on a surface of the electrophotographic photosensitive member or the like.

The process cartridge 1 shown in this embodiment is configured to rotate the photosensitive-member drum that is an electrophotographic photosensitive member having a photosensitive layer, to apply a voltage to a charging roller 16 that is the charging means in order to uniformly charge a surface of the photosensitive-member drum 15, to expose the charged photosensitive-member drum 15 to an optical image from the optics 25 via an exposure opening (not shown) to form an electrostatic latent image, and to develop the electrostatic latent image using developing means 5, as shown in FIG. 1. That is, the charging roller 16 is provided in contact with the photosensitive-member drum for charging. The charging roller 16 rotates in a fashion following the photosensitive-member drum 15.

The developing means 5 feeds a toner T in a toner container 4 to an opening 6 in the toner container 4 using a rotatable toner feeding member (not shown) and then feeds the toner into a developing container 3 through the opening 6. Then, the toner is agitated by a toner agitating member (not shown), and a developing sleeve 5*a* in the form of a developer bearer incorporating a fixed magnet is rotated, while a developing blade 5*b* forms on a surface of the developing sleeve 5*a*, a toner layer to which frictionally charged charges are applied. The toner is then shifted to the photosensitive-member drum 15 depending on the electrostatic latent image to visibly form a toner image.

Then, a voltage of a polarity opposite to that of the toner image is applied to the transfer roller 22 to transfer the toner image to the recording medium 20, and cleaning means 17 removes a residual toner on the photosensitive-member drum 15 by scraping off the residual toner using a cleaning blade 17*a*, while scooping it up using a scoop sheet 17*b*, so that it is removed-toner containing portion 17*c*.

The members including the photosensitive-member drum 15, the charging roller 16, and the developing sleeve 5*a* or the like are contained in a cartridge flame configured by coupling a developing unit 1A that is a developing device and a cleaning container 2 together, thereby configuring a cartridge. The cartridge is installed in cartridge-installation means (see FIG. 3) detachably/attachable in the direction of arrow C (see FIG. 5), the cartridge-installation means being provided in an image-forming-apparatus main body 26. The developing unit 1A joins a toner container 4 that is a developer container configuring a toner containing portion 4*a* and supporting the toner feeding member for rotative driving, with the developing container 3 incorporating developing members including the toner agitating member, the developing sleeve 5*a*, and the developing blade 5*b*, whereby the developing unit 1A is integrated with the toner container 4 and the developing container 3. The cleaning container 2 constitutes the removed-toner containing portion 17*c* and supports the photosensitive-member drum 15, the cleaning blade 17*a*, the scoop sheet 17*b*, and the charging roller 16. The developing unit 1A and the cleaning container 2 are coupled together to constitute the cartridge frame.

Figure 3:
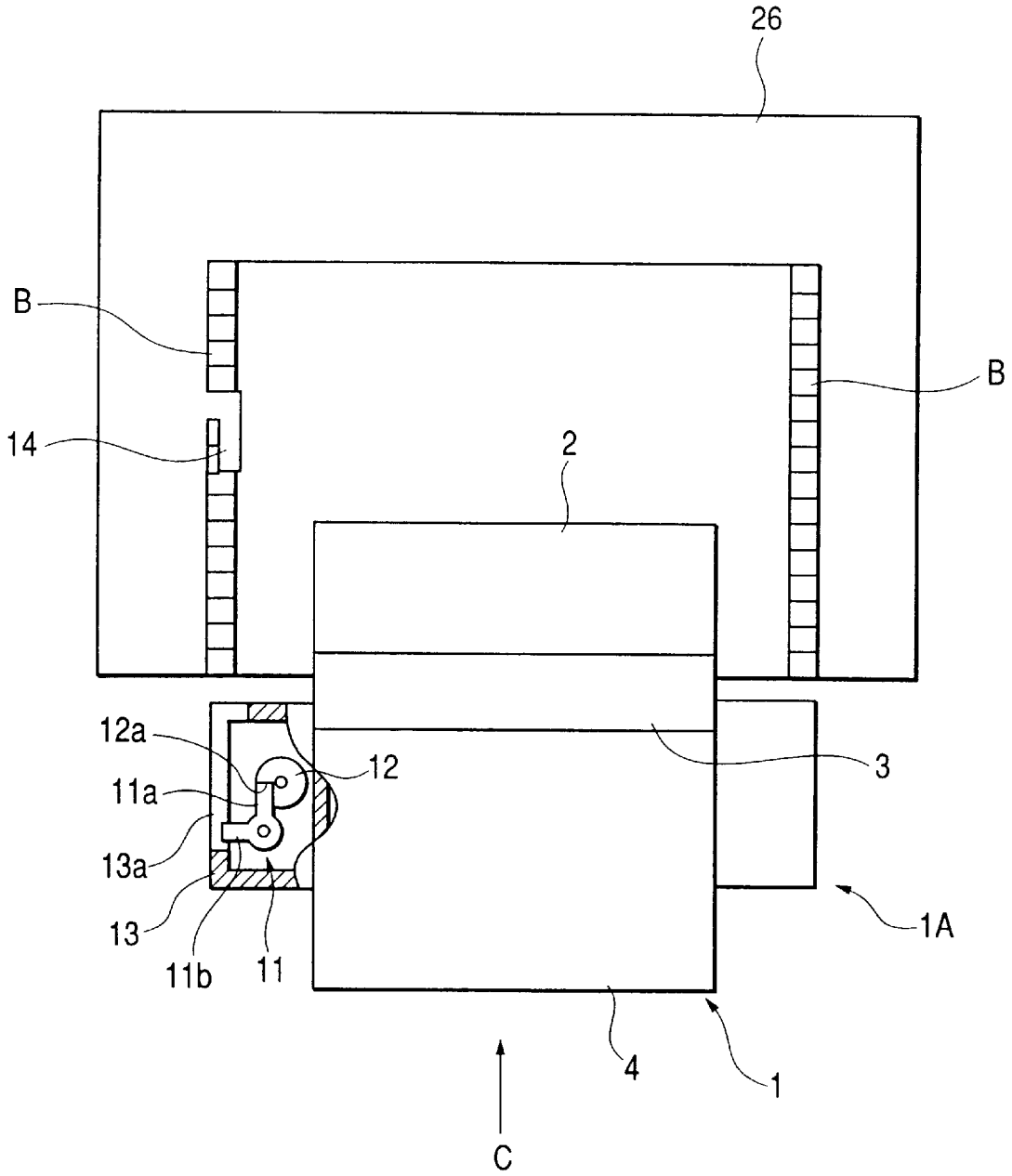
FIG. 3 is a top view showing how the process cartridge is inserted into an image forming apparatus main body.

With respect to the cartridge-installation means, when an opening and closing member 27 is opened around a shaft 27*a* provided in the image-forming-apparatus main body 26, a space in the cartridge-installation portion is exposed as shown in FIG. 5; guide rails B are disposed to the right and left of this space as cartridge-installation guide members (see FIG. 3). Guides (not shown), each consisting of a boss and a rib provided on a corresponding one of the both outer side surfaces of the process cartridge extending in its longitudinal direction (the axial direction of the photosensitive-member drum 15), are each fitted in the guide rail B and guided therethrough, so that the process cartridge 1 is installed in the image-forming-apparatus main body 26 in the direction of arrow C.

(Toner-Seal Sticking Configuration)

Figure 2:
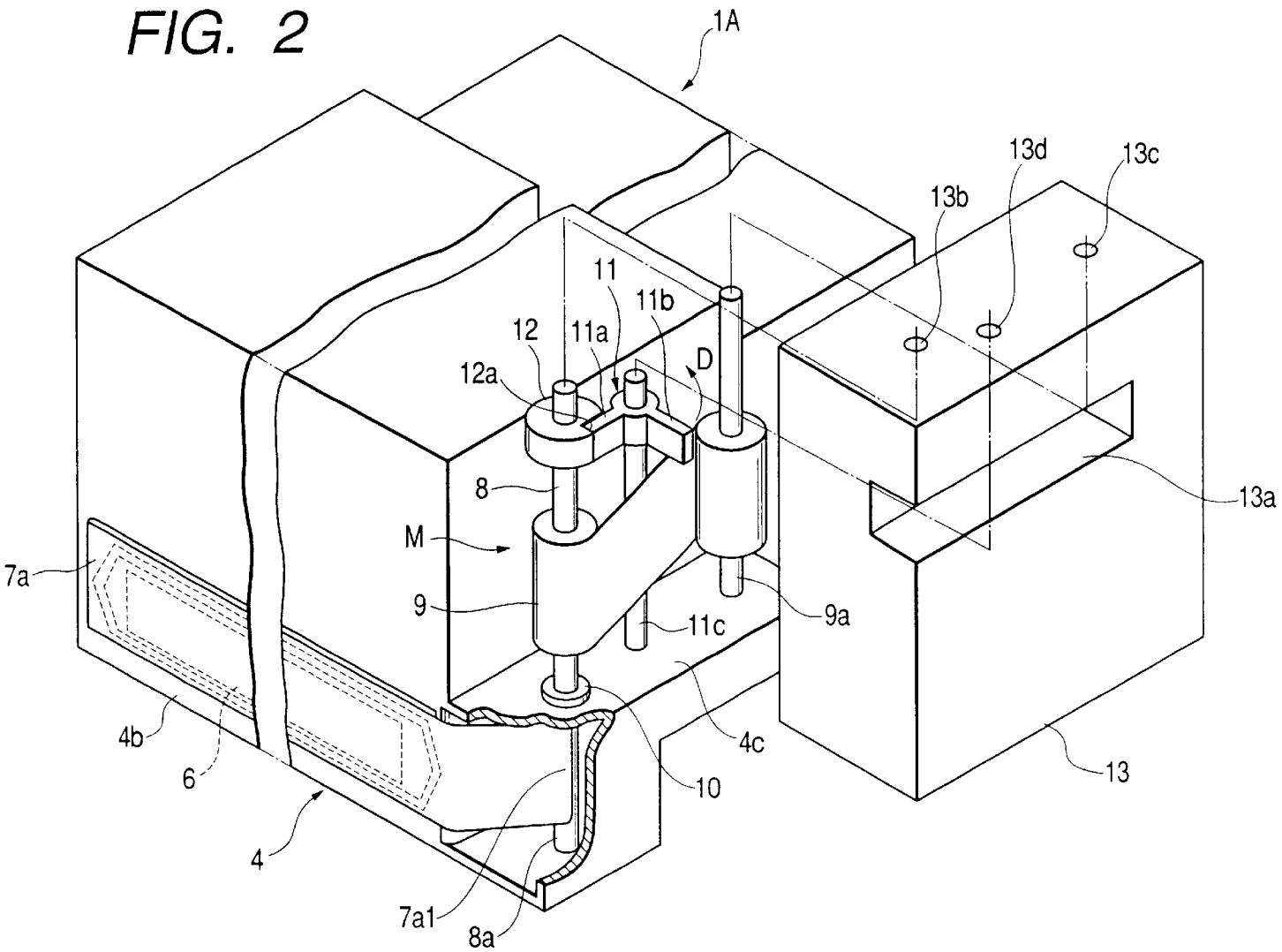
FIG. 2 is an explanatory drawing of a toner-seal sticking configuration and an automatic toner-seal unsealing mechanism.

Next, a toner-seal sticking configuration for sealing the opening in the developing unit will be described with reference to FIGS. 1 and 2. FIG. 2 is an explanatory drawing of the toner-seal sticking configuration and an automatic toner-seal unsealing mechanism.

As shown in FIG. 1, the toner container 4 of the developing unit 1A has the toner T contained in its toner containing portion 4*a* and has the opening 6 in a surface 4*b* opposed to the developing sleeve 5 of the toner container 4 in order to supply the developing sleeve 5 with the toner T in the toner-containing portion 4*a* (see FIG. 2). The opening 6 extends in a longitudinal direction (an axial direction of the developing sleeve 5) of the developing unit 1A as shown in FIG. 2. In FIG. 2, the developing container 3 of the developing device is omitted. The toner container 4 has a toner seal 7, that is, a seal member welded on the surface 4*b* along the edges of four sides of the opening 6 in such a manner as to occlude the opening 6. The toner seal 7 has a folded-back portion 7*a* at one longitudinal end of the opening 6, with a tip 7*a*1 of the folded-back portion 7*a* fixed to a winding portion 8*a* of a seal winding shaft 8 of an automatic unsealing mechanism M, which will be described below. In this manner, the toner seal 7 seals the opening 6 in the toner container 4 to block both the toner T in the toner container 4 and the developing sleeve 5 in the developing container 3 while the process cartridge 1 is unused.

(Configuration of the Automatic Toner-Seal Unsealing Mechanism)

Next, a configuration of the automatic toner-seal unsealing mechanism will be explained with reference to FIG. 2.

As shown in FIG. 2, the automatic unsealing mechanism M shown in this embodiment has the seal winding shaft 8 that is a winding member, a rotative-drive source 9, and a stopper 11 that is holding means. The seal winding shaft 8, the rotative-drive source 9, and the stopper 11 are attached to a support table 4*c* provided on a side surface of the toner container 4 so as to project in the longitudinal direction of the developing unit 1A, the side surface being located at the tip 7*a*1 of the folded-back portion 7*a* of the toner seal 7.

The seal winding shaft 8 is rotatively supported on the support table 4*c* in a direction parallel with the surface 4*b* of the toner container 4 described above. In particular, the seal winding shaft 8 is rotatably supported on the support table 4*c* via a seal member 10 such as an oil seal, which has a sealing capability, thereby preventing the toner in the toner container 4 from leaking to the exterior. In addition, the seal winding shaft 8 has a winding portion 8*a* in the toner container 4. The winding portion 8*a* has the tip 7*a*1 of the toner seal 7 fixed thereto by means of screwing, welding, or adhesion. The seal winding shaft 8 has its lower end fitted in a hole (not shown) in the toner container 4 and its upper end fitted in a hole 13*b* in a holder 13 subsequently attached to the support table 4*c* of the toner container 4. The seal winding shaft 8 is rotatably held by the toner container 4 and the holder 13.

The rotative-drive source 9 is configured by a constant-load spring acting as an elastic member such that a restoring force of the constant-load spring is used to rotate the seal winding shaft 8. That is, the constant-load spring 9 acting as an elastic member that is a rotative-drive source has the other end fixed to a spring support shaft 9*a* fixedly supported on the support table 4*c* in parallel with the seal winding shaft 8, while having one end fixed to the seal winding shaft 8 by means of screwing. The spring support shaft 9*a* has a lower end fitted in a hole (not shown) in the support table 4*c* and an upper end fitted in a hole 13*c* in the holder 13, and is held by the support table 4*c* and the holder 13. The constant-load spring 9 shown in this embodiment has one end fixed to the seal winding shaft 8 with a restoring force charged beforehand so as to rotate the seal winding shaft 8 to wind the toner seal 7. In this manner, the constant-load spring 9 has one end fixed to the seal winding shaft 8 with the restoring force charged, thereby enabling the toner seal 7 to be completely unwound and unsealed.

Although this embodiment uses the constant-load spring 9 as an elastic member that is a rotative drive source, a (flat) spiral spring may be used instead of the constant-load spring 9. This is because the constant-load spring or flat spiral spring can be subjected to a relatively large deflection, whereby it is suitable for a case where the seal winding shaft 8 to which one end of the toner seal 7 is fixed is rotated to pull and unseal the toner seal 7 in the longitudinal direction.

The stopper 11 is rotatably attached to a stopper-support shaft 11*c* fixedly supported on the support table 4*c* in parallel with the seal winding shaft 8. The stopper-support shaft 11*c* has a lower end fitted in a hole (not shown) in the support table 4*c* and an upper end fitted in a hole 13*d* in the holder 13, and is held by the support table 4*c* and the holder 13. The stopper 11 integrally has a holding section 11*a* for holding the constant-load spring 9 in such a manner that its restoring force can be charged, and an arm portion 11*b* for releasing the charged state of the constant-load spring 9. The stopper 11 engagingly locks the holding portion 11*a* in a notch 12*a* in a pedestal 12 fixedly provided around an upper part of the seal winding shaft 8 to hold the restoring force of the constant-load spring 9 charged. In this manner, according to this embodiment, the toner seal 7 is prevented from temporal fatigue by allowing the pedestal 12 provided around the seal winding shaft 8 to be held by the holding portion 11*a* of the stopper 11, thereby hindering the restoring force of the constant-load spring 9 from being transmitted to the toner seal 7. In addition, when pressed by a pin 14 in the form of a projection that is a releasing member of the image-forming-apparatus main body 26, which will be described below, the arm portion 11*b* of the stopper 11 is rotated in the direction of arrow D to remove the holding portion 11*a* from the notch 12*a* in the pedestal 12, thereby releasing the charged state of the restoring force of the constant-load spring 9.

As described above, the parts provided on the support table 4*c* of the developing unit 1A and including the seal winding shaft 8, the constant-load spring 9, the stopper 11, and the pedestal 12 are housed inside the holder 13 attached to the support table 4*c*. The holder 13 has a groove 13*a* formed in a side surface thereof and into which the pin 14 of the image-forming-apparatus main body 26 advances. In addition, the holder 13 has the holes 13*b*, 13*c*, and 13*d* formed in a top surface thereof, wherein an upper end of the seal winding shaft 8 is fitted in the hole 13*b*, wherein an upper end of the spring support shaft 9*a* is fitted in the hole 13*c*, and wherein an upper end of the stopper-support shaft 11*c* is fitted in the hole 13*d*. The holder 13 is assembled on the support table 4*c* after the seal winding shaft 8, the constant-load spring 9, and the stopper 11 have been attached to the support table 4*c*.

(Description of the Pin (the Releasing Member) of the Image-Forming-Apparatus Main Body)

Next, the pin of the image-forming-apparatus main body will be explained with reference to FIG. 3. FIG. 3 is a top view showing how the process cartridge is inserted into the image-forming-apparatus main body.

As shown in FIG. 3, the process cartridge 1 is inserted into the image-forming-apparatus main body 26 along the guide rails B in the insertion direction indicated by arrow C. The image-forming-apparatus main body 26 has the pin 14 in the longitudinal direction of the process cartridge 1 (the axial direction of the photosensitive member drum 15) and opposite to the holder 13 of the developing unit 1A, the pin being in the form of a projection and operating as a releasing member. When the process cartridge 1 is inserted close to a regular installation position, which is shown in FIG. 5, the pin 14 advances into the groove 13*a* formed in the side surface of the holder 13 to abut on the arm portion 11*b* of the stopper 11, thereby releasing the charging of the restoring force of the constant-load spring 9 effected by the stopper 11. Thus, the restoring force of the constant-load spring 9 rotates the seal winding shaft 8 to automatically unseal the toner seal 7.

(Description of Automatic Toner-Seal Unsealing (Automatic Winding))

Figure 4:
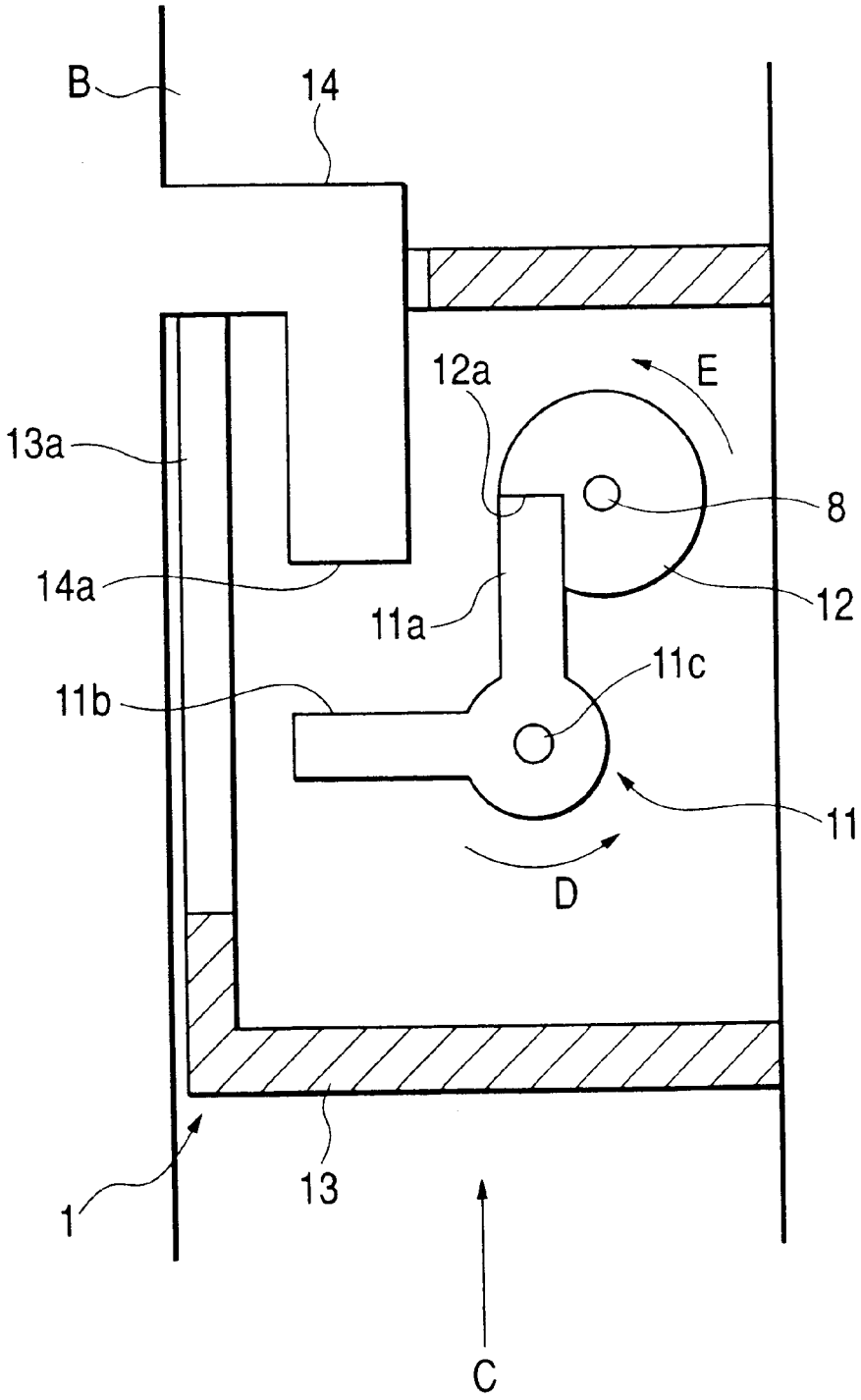
FIG. 4 is an explanatory drawing showing a state where the charging condition of a restoring force of a constant-load spring effected by a stopper is released (canceled)

Next, automatic toner-seal unsealing will be explained in detail with reference to FIG. 4. FIG. 4 is an explanatory drawing showing how the charging of the restoring force of the constant-load spring effected by the stopper is released.

As shown in FIG. 4, before the process cartridge 1 is inserted into the regular installation position shown in FIG. 5, the stopper 11 engagingly locks its holding portion 11*a* in the notch 12*a* in the pedestal 12 to hold the restoring force of the constant-load spring 9 (not shown) charged. When the process cartridge 1 is further inserted from the position shown in FIG. 4, a tip 14*a* of the pin 14 abuts on the arm portion 11*b* of the stopper 11 to press it to rotate the stopper 11 around the stopper support shaft 11*c* in the direction of arrow D. The holding portion 11*a* of the stopper 11 is thereby taken off the notch 12*a* of the pedestal 12, while simultaneously the charging of the restoring force of the constant-load spring 9 effected by the stopper 11 is released, thereby rotating the seal winding shaft 8 in the direction of arrow E due to the restoring force of the constant-load spring 9 to wind and unseal the toner seal 7.

Shown below is an example of the dimensions of the constant-load spring 9, which is associated with a pull-out force (a winding force) applied to the toner seal 7 by the rotation of the seal winding shaft 8 in the process cartridge 1 according to this embodiment.

A pull-out force that must be applied to the toner seal 7 is assumed to be 3 [kgf] ($3\times9.806\cong29.4$ N). If the seal winding shaft 8 has an axial diameter of 8 [mm], a required axial torque is 12 [kgf.mm] ($12\times9.806\cong117.7$ J). In addition, the torque of the constant-load spring 9 depends on its material, radius of curvature, board thickness, and board width. If the material of the constant-load spring 9 is SUS301CSP-EH (elastic modulus E=19,300) [kgf.mm$^2$]), its radius of curvature is 10 [mm], its board width is 12 [mm], and its board thickness is 0.15 [m]), then the axial torque is 13 [kgf.mm] ($13\times9.806\cong127.5$ N.mm) and the pull-out force is 3.26 [kgf] ($3.26\times9.806\cong32.0$ N), which meets the above requirement for the pull-out force for the toner seal 7, that is, 3 [kgf] ($3\times9.806\cong29.4$ N).

Accordingly, if the constant-load spring 9 is used as an elastic member that is a rotative-drive source, a pull-out force can be obtained which is sufficient to rotate the seal winding shaft 8 to pull out the toner seal 7.

As described above, in the developing unit 1A comprising the automatic unsealing mechanism M and the process cartridge 1 having the developing unit 1A, both of which are shown in this embodiment, the constant-load spring 9 that is an elastic member is used as a rotative-drive source for rotating the seal winding shaft 8. Consequently, the toner seal 7 can be unsealed automatically without the use of a power transmission device, such as a gear, which is driven by a motor as in the above-discussed conventional process cartridge. Besides, the automatic unsealing mechanism M has a simple configuration due to the elimination of the need for a motor and a gear used as transmission devices. In addition, the present drive source for winding up the toner seal serves to reduce manufacturing costs compared to process cartridges with a motor integrated therein. Further, the present drive source for winding up the toner seal advantageously serves to reduce the burden on users compared to process cartridges that require manual winding based on rotation of a handle provided in the process cartridge.

In addition, since only the winding portion 8*a* of the seal winding shaft 8 with the toner seal 7 fixed thereto is contained in the toner container 4, the toner seal 7 is contained in the toner container 4 after winding. By containing the toner seal 7 in the toner container 4 in this manner, opposed surfaces of the toner container 4 and developing container 3 can be welded perfectly, thereby eliminating the need for an opening through which the toner seal 7 is pulled out from the process cartridge 1. This configuration also eliminates the need for a seal member used in the prior art for prevention of blowcut of the toner.

In addition, the toner seal 7 is contained inside the toner container 4, whereby the user can prevent the toner seal 7 from being contaminated with a trace amount of toner adhering thereto, without the need to process the toner seal 7.

Further, since the seal winding shaft 8 is supported by the support 4*c* using the seal member 10 such as an oil seal which has a sealing capability, the toner in the toner container 4 is prevented from leaking to the exterior.

In addition, the constant-load spring 9 acting as an elastic member that is a rotative-drive source is disposed outside the toner container 4, so that it can be replaced easily with a new one for reuse.

Further, the toner seal 7 is prevented from temporal fatigue because the pedestal 12 provided around the seal winding shaft 8 is held by the holding section 11*a* of the stopper 11 to hinder the restoring force of the constant-load spring 9 from being transmitted to the toner seal 7.

In addition, since the pin 14 provided on the image-forming-apparatus main body 26 advances into the groove 13*a* in the holder 13 of the developing unit 1A to accommodate the stopper 11 inside the holder 13, the user is prevented from mistakenly releasing the charging of the restoring force of the constant-load spring 9 effected by the stopper 11 before installing the process cartridge 1 in the image-forming-apparatus main body 26.

Embodiment 2

[General Configuration]

Figure 16:
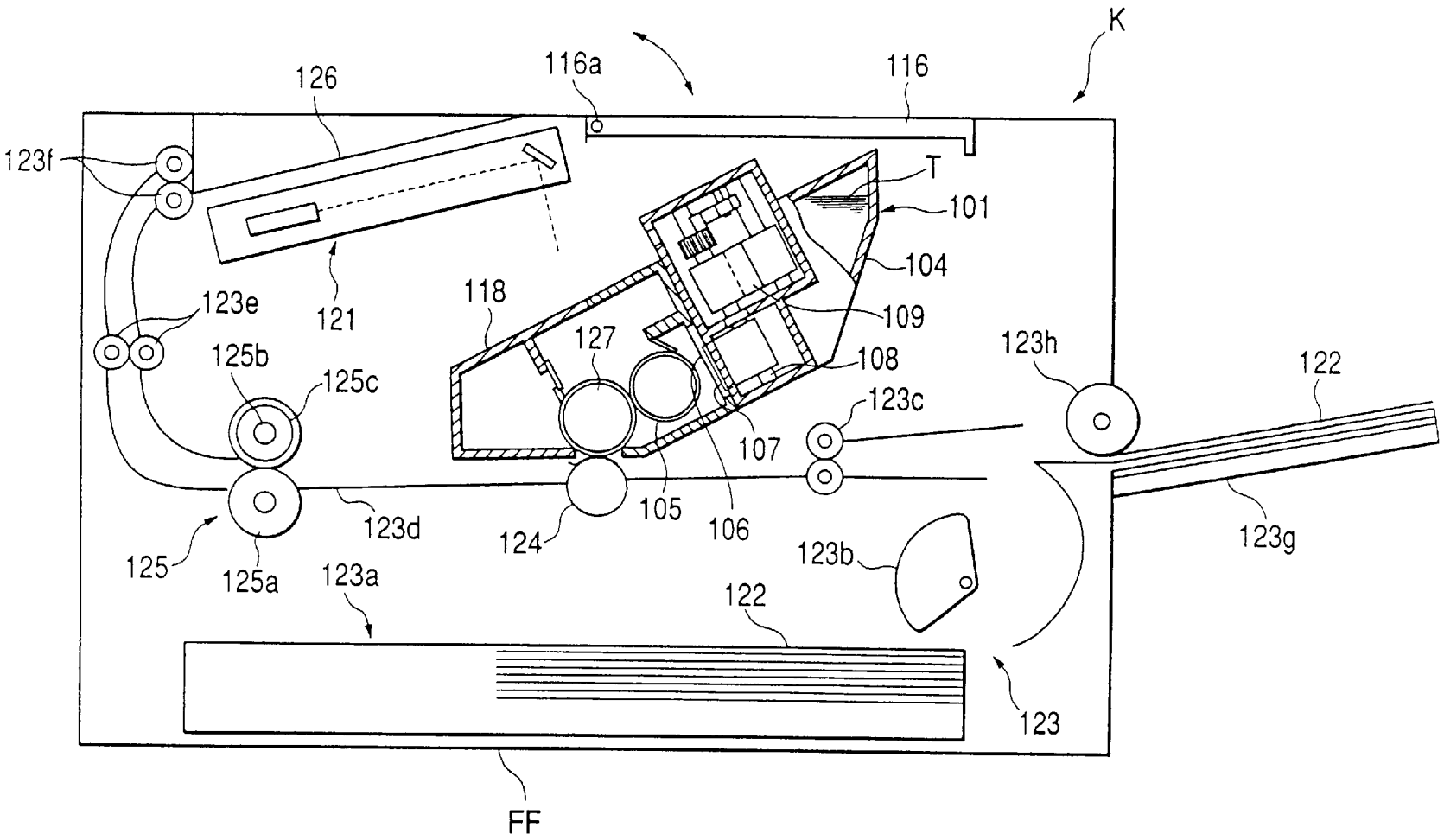
FIG. 16 is a vertical sectional view of an electrophotographic image forming apparatus.

As shown in FIG. 16, this electrophotographic image forming apparatus (laser beam printer) K irradiates a drum-shaped electrophotographic photosensitive member with a laser light image based on image information from optics 121 to form a latent image on the photosensitive member, and then develops this latent image to form a toner image. In synchronism with the formation of the toner image, a recording medium 122 is conveyed by convey means 123 consisting of a pickup roller 123*b*, a pair of registration rollers 123*c*, and other components, and the toner image formed on the photosensitive member drum is applied under voltage to a transfer roller 124 that is transfer means, whereby the image is transferred to the recording medium 122. The recording medium 122 is then conveyed to fixing means 125 by means of a guide plate 123*d*. The fixing means 125 consists of a drive roller 125*a* and a fixing roller 125*c* incorporating a heater 125*b*, and applies heat and pressure to the passing recording medium 122 to fix the transferred toner image thereto. The recording medium 122 is then conveyed by a pair of discharging rollers 123*e*, 123*f* and discharged to a discharge portion 126 through a turnover convey path. The image forming apparatus K enables manual feeding using a manual-feeding tray 123*g* and a roller 123*h*.

Figure 6:
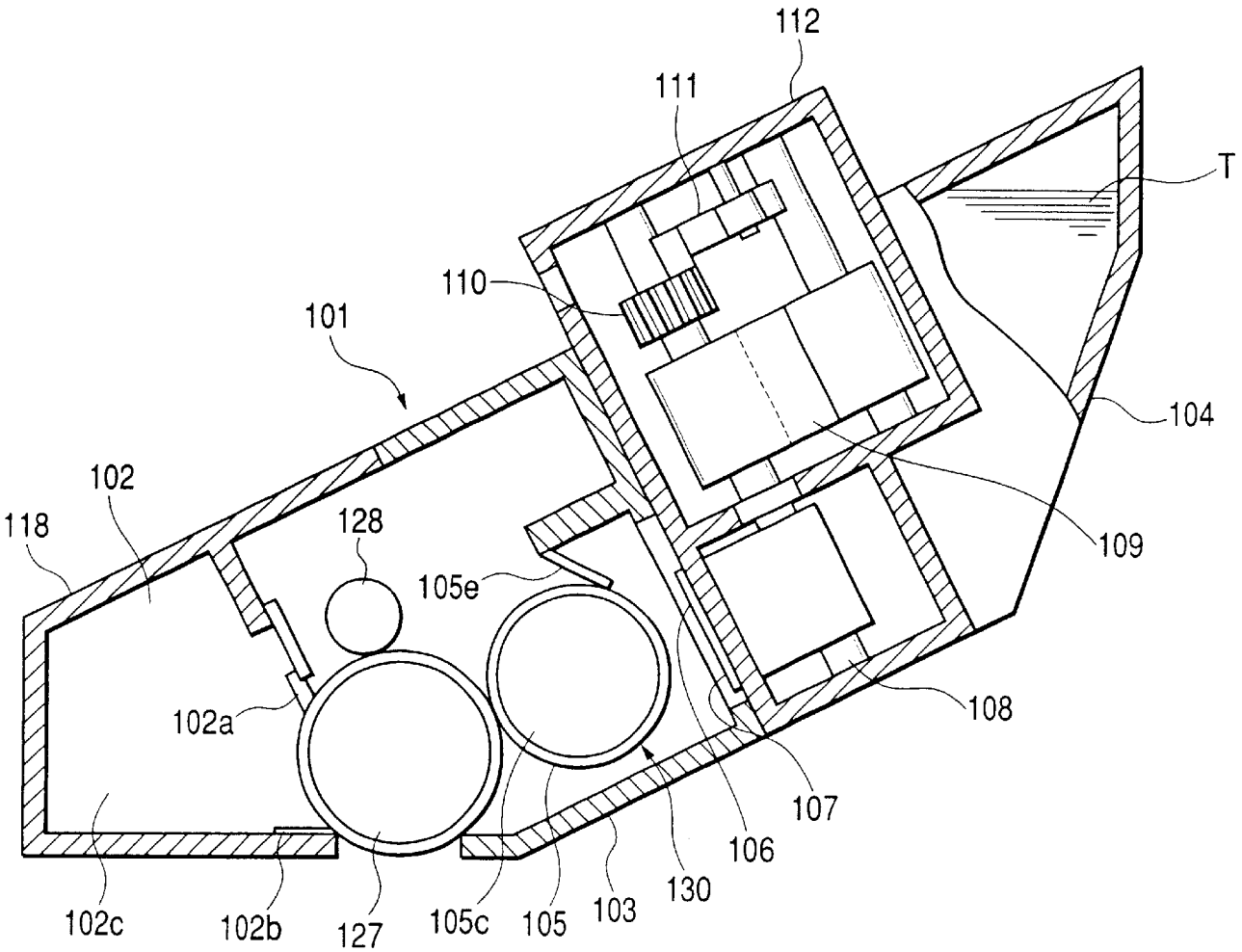
FIG. 6 is a vertical, sectional view of the process cartridge showing an embodiment of the present invention.

On the other hand, the process cartridge 101 comprises an electrophotographic photosensitive member and at least one process means, as shown in FIG. 6. The process means may be, for example, charging means for charging the electrophotographic photosensitive member, developing means for developing an electrostatic latent image formed on the electrophotographic photosensitive member, or cleaning means for cleaning a toner remaining on a surface of the electrophotographic photosensitive member. The process cartridge 101 according to this embodiment is configured to rotate a photosensitive member drum 127 that is an electrophotographic photosensitive member, to apply a voltage to a charging roller 128 that is the charging means in order to uniformly charge a surface of the photosensitive member drum 127, to expose the charged photosensitive member drum 127 to information light from the optics 121 to form a latent image, and to develop the latent image using developing means 130, as shown in FIG. 6. The developing means 130 feeds a toner T in a toner container 104 through an opening 106 using a toner feeding member (not shown). A developing sleeve 105 incorporating a fixed magnet 105*c* is rotated, while a developing blade 105*e* forms on a surface of the developing sleeve 105, a toner layer to which frictionally charged charges are applied. The toner is then shifted to the photosensitive member drum 127 in accordance with the latent image to visualized by forming a toner image. Then, a voltage of a polarity opposite to that of the toner image is applied to a transfer roller 124 to transfer the toner image to the recording medium 122 and cleaning means 102 then removes a residual toner on the photosensitive member drum 127 by scraping off the residual toner using a cleaning blade 102*a*, while scooping it up using a scoop sheet 102*b*, so that it is collected in a removed toner reservoir 102*c*.

The members including the photosensitive member drum 127 are contained in a cartridge frame to form a cartridge, which is detachably/attachably installed in a cartridge installation means provided in the apparatus body K; the cartridge frame is configured as follows: a toner container 104 for containing the toner and a developing container 103 for containing developing members such as the developing sleeve 105 are welded together to constitute a developing unit, and this developing unit and a cleaning unit comprising a cleaning container 118 with the photosensitive member drum 127 and the cleaning means 102 attached thereto are coupled together to constitute the cartridge frame, as shown in FIG. 6

The cartridge-installation means can be seen when a main-body cover 116 is opened around a hinge 116*a*, as shown in FIG. 16. Cartridge-installation guide portions G are provided opposite to each other and to the right and left of a cartridge-installation space in such a manner that their front sides relative to the apparatus are lower than their rear sides. These guide portions G operate as guides during insertion of the process cartridge 101. Bosses (not shown) projected from opposite longitudinal sides of the cartridge frame and ribs (not shown) following the bosses are guided on the guide portions G to insert the process cartridge 101, and the main-body cover 116 is then closed to install the process cartridge 101 in the image forming apparatus K.

FIG. 6 shows a sectional view of the process cartridge. The process cartridge 101 is composed of the cleaning container 118, the developing container 103, the toner container 104, and other components.

The toner container 104 has the unused toner T contained therein and has an opening 106 formed in its surface opposed to the developing sleeve 105 of the toner container 104, the opening being used to supply the toner T to the developing sleeve 105. While the process cartridge is unused, a seal member 107 (hereafter referred to as a "toner seal") is welded to the opening 106 to block the developing sleeve 105 from the toner T. In addition, the toner container 104 has a seal winding shaft 108, a constant-load spring 109 or a flat spiral spring acting as an elastic member, a gear 110 that is a segment gear, a stopper 111, etc. formed on a side surface of the toner container 104.

Figure 7:
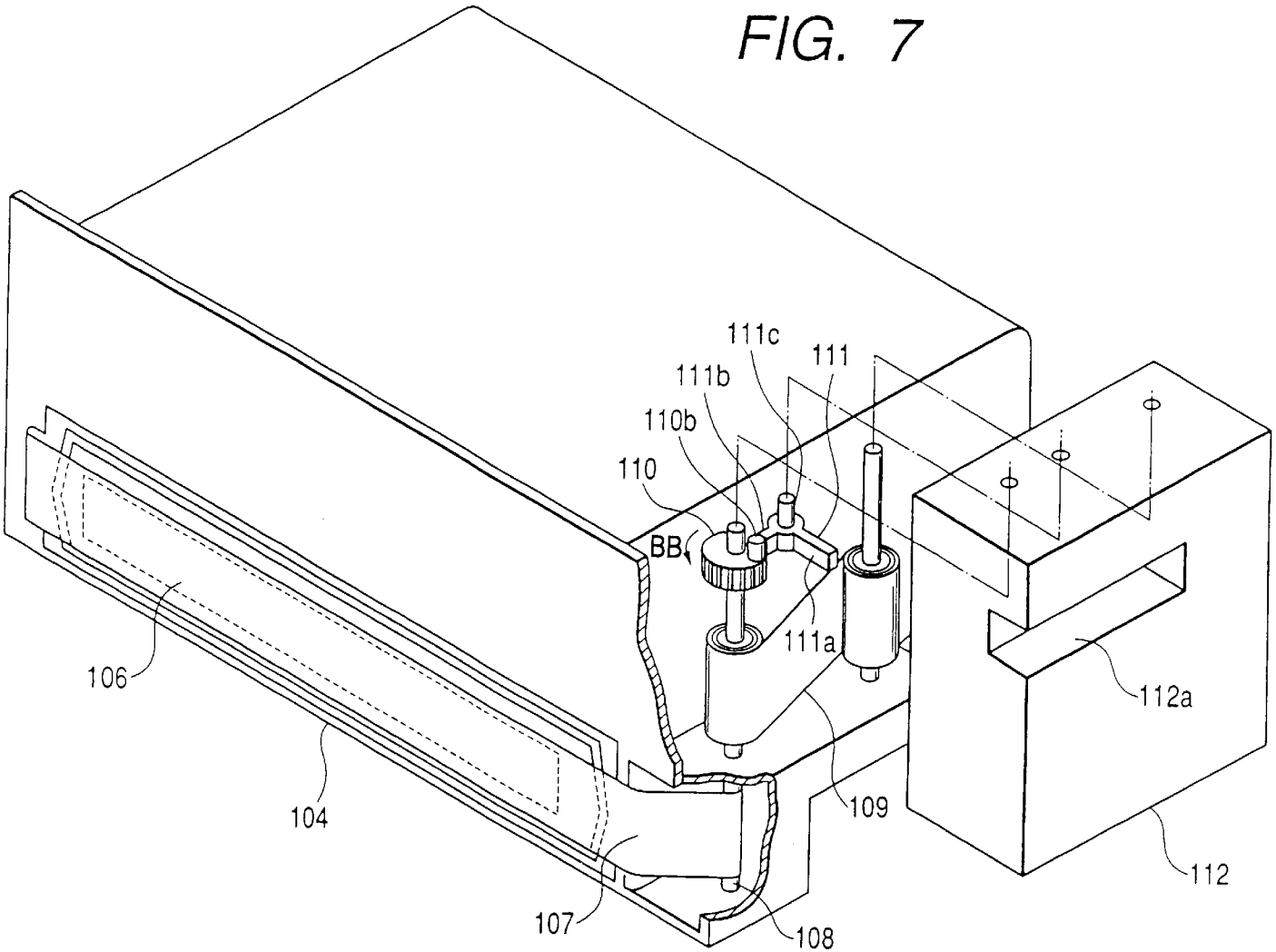
FIG. 7 is a perspective view of a toner-container section of the process cartridge in FIG. 6 (before winding)

FIG. 7 shows a perspective view of the toner-container portion. As seen in FIG. 7, the seal winding shaft 108 is provided rotatably at the toner container 104 rotation. The seal winding shaft 108 has an elastic member, such as the constant-load spring 109 attached thereto and acting as a drive source, and also has the gear 110 attached thereto for triggering pulling of the seal. The stopper 111 is rotatably supported in the toner container 104 by means of a stopper shaft 111*c* extending parallel with the seal winding shaft 108, in order to hold the charged state of the elastic member. The stopper 111 abuts on a pin 110*b* fixed to the gear 110 to stop the rotation of the gear 110 effected by the constant-load spring 109. The stopper shaft 111*c* is located on a tangent to a circle having its center at the shaft 108 and passing through the pin 110*b*. The stopper 111 is in the form of a bell crank having two arms, that is, a stop arm 111*b* and an operative arm 111*a*. The elastic member 109 or the like is contained in a holder 112 attached to the toner container 104. The seal winding shaft 108 has one end of the toner seal 107 fixed thereto by means of screwing, welding, or adhesion. In addition, since one end of the constant-load spring 109 is fixed to the seal winding shaft 108 by screwing or the like, the toner seal 107 can be wound up by rotating the shaft based on a restoring force of the constant-load spring 109. Further, the gear 110 is fixed to the seal winding shaft 108 so as to rotate integrally with this shaft 108. The constant-load spring or flat spiral spring can be subjected to a relatively large deflection, whereby it is suitable for a case where the toner seal is pulled in the longitudinal direction. The pin 110*b* of the gear 110 is stopped by the stopper 111 to hold the constant-load spring 109 in he charged state.

Figure 8:
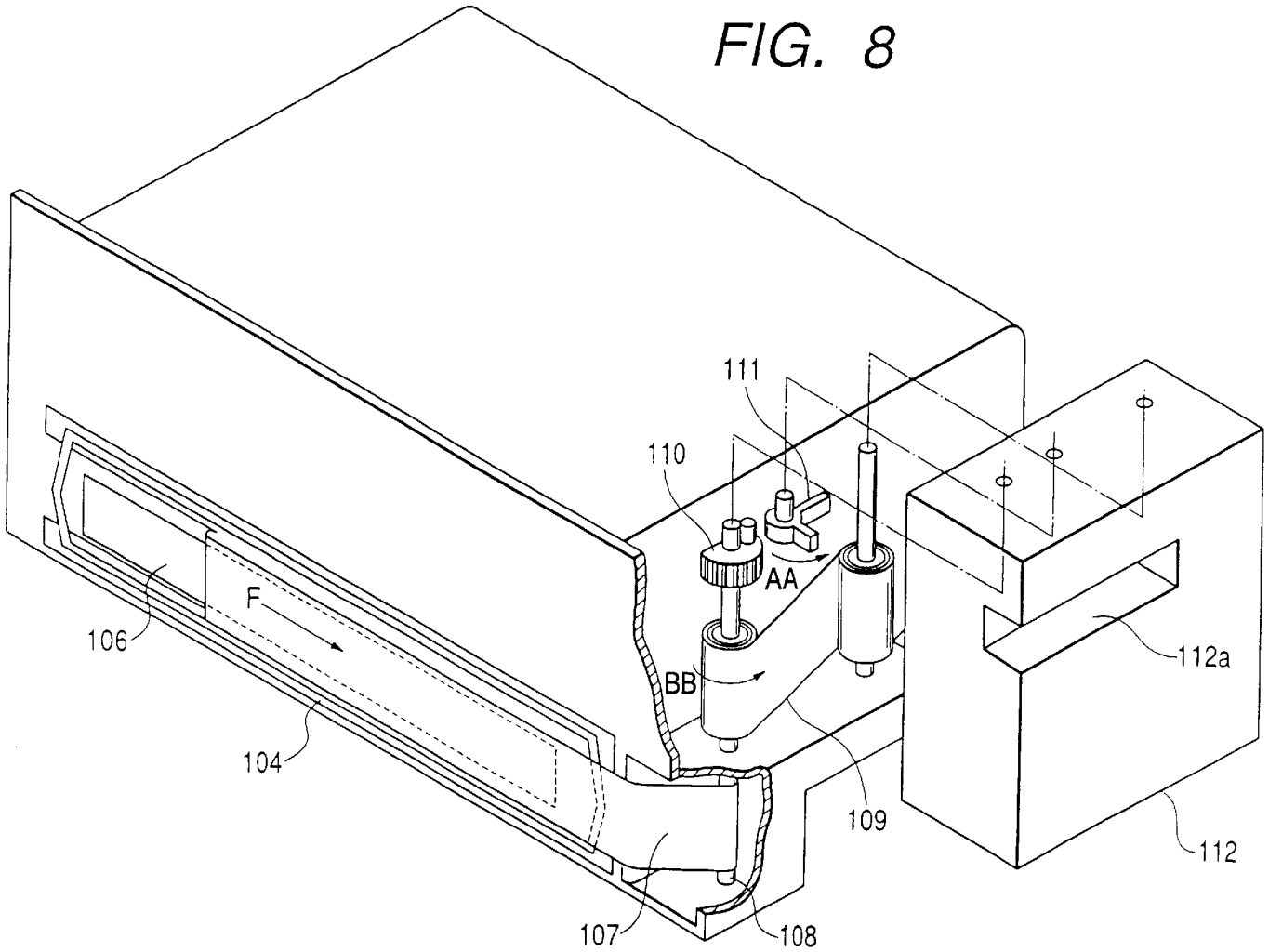
FIG. 8 is a perspective view of a toner-container section of the process cartridge in FIG. 1 (during winding)

FIG. 8 is a perspective view of the toner container 104 showing that the stopper 111 has been released and that the toner seal 107 is being wound up. The stopper 111 is released by rotating it in the direction of arrow AA, and the toner seal 107 is wound up in the direction of arrow F by rotating the seal winding shaft 108 in the direction of the arrow BB using a spring force of the constant-load spring 109.

Figure 9:
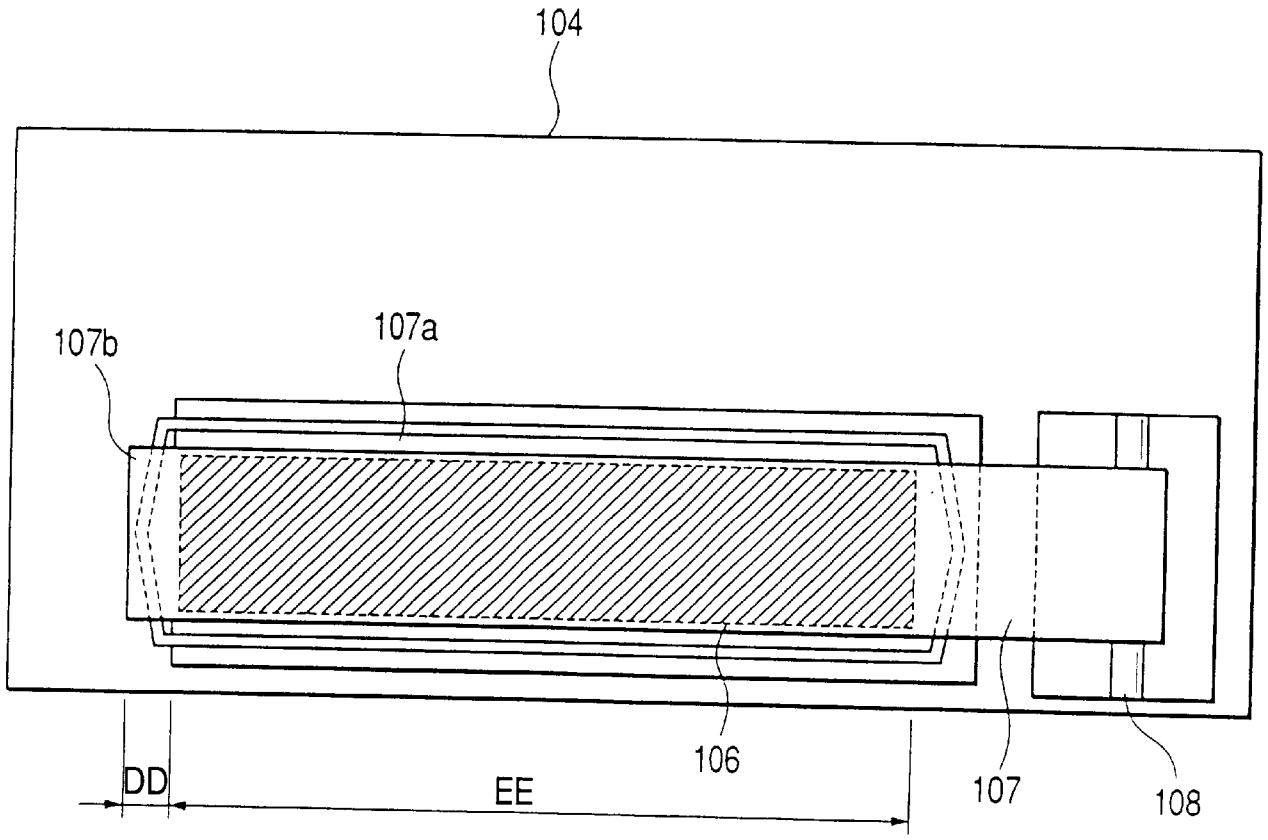
FIG. 9 is a front view of the process cartridge in FIG. 2 as seen from a developing-container side.
Figure 10:
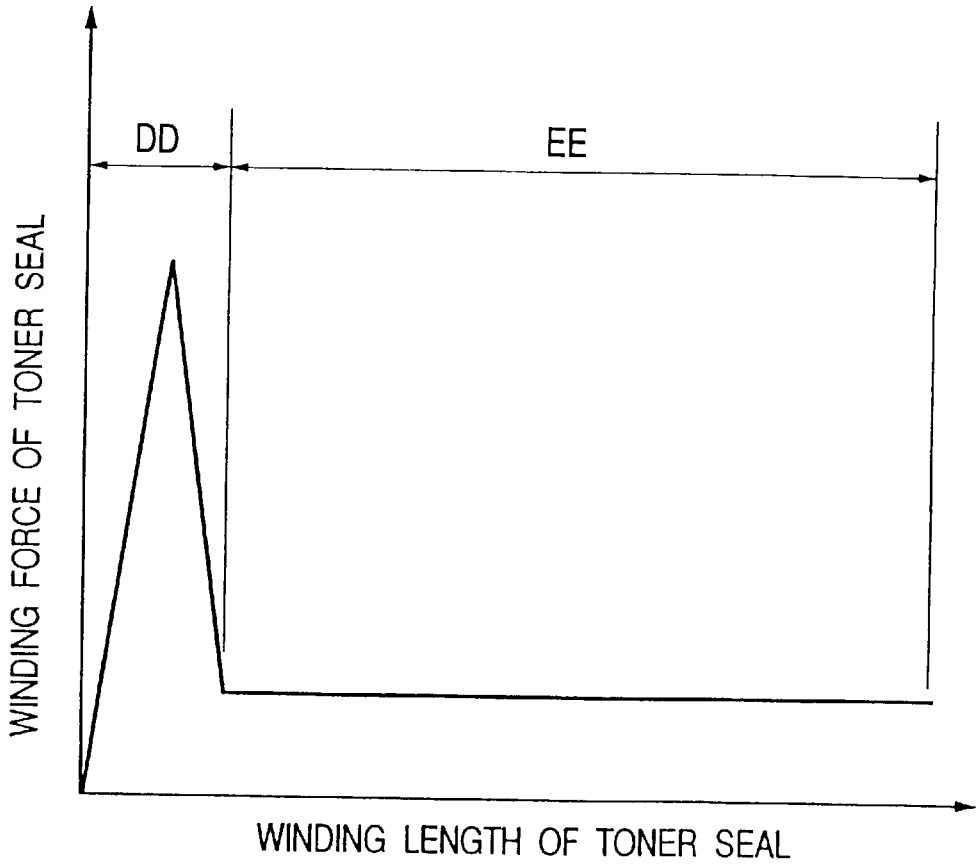
FIG. 10 is a diagram showing the relationship between the winding length of a toner seal and toner-seal winding force.

FIG. 9 is a front view of the toner container 104 as seen from the developing-container side. The toner seal 107 has a cover-seal portion 107*a* welded to the toner container 104 in a fashion surrounding a periphery of the opening 106 (oblique lined portion) in the toner vessel 104. The toner seal 107 is folded back at a folded-back portion 107*b* at a corresponding end of the cover-seal portion 107*a* so as to overlap the cover-seal portion 107*a*, and is fixed to the shaft 108 on the other side. To unseal the toner seal 107, a welded portion close to the folded-back portion 107*b* is peeled off within a range D, and the toner seal 107 is torn up at a welded portion within a range EE. The force required for unsealing is as shown in FIG. 10, and is large within the range D and small within the range E. To wind up the toner seal 107 within the range DD, the gear 110 shown in FIG. 7 is rotated in synchronism with an operation for installing the process cartridge 101 in an apparatus body FF. After the toner seal 107 within the range DD has been wound up, the toner seal 107 within the range E is wound up because of the restoring force of the constant-load spring 109. That is, the constant-load spring 109 is not required to have a force sufficient to peel off the toner seal 107 within the range DD to wind it up.

Figure 11:
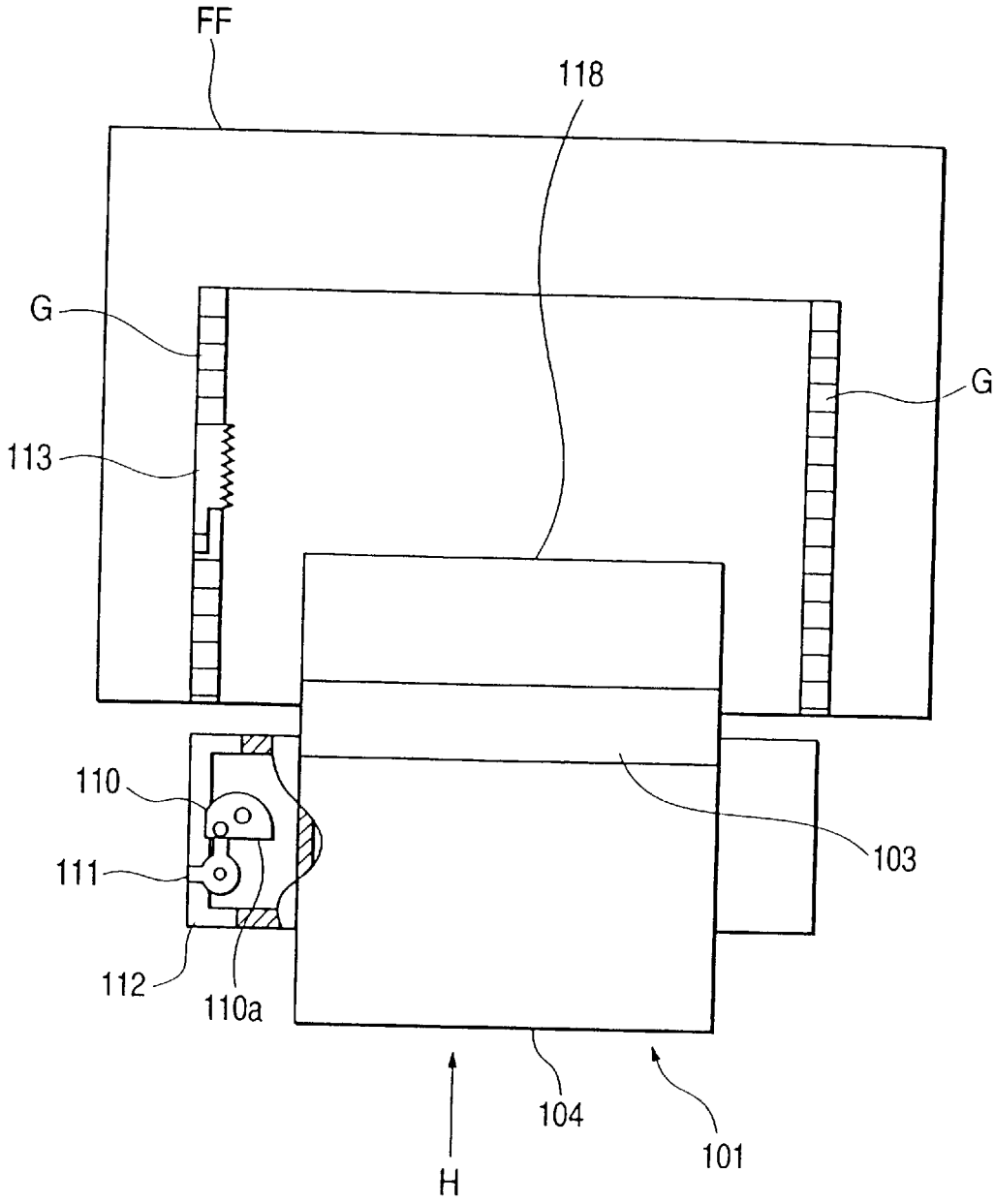
FIG. 11 is a plan view showing a state where the process cartridge in FIG. 6 is installed in an image forming apparatus.

FIG. 11 is a top view showing how the process cartridge 101 is installed in the image-forming-apparatus main body FF. The process cartridge 101 is inserted into the image-forming-apparatus main body FF in the direction indicated by arrow H by sliding guide portions (not shown) of the process cartridge 101 along the guides G provided in the apparatus main body FF. When the process cartridge 101 has been inserted close to a normal installation position, a rack member 113 provided in the apparatus main body FF is inserted through a groove 112*a* formed in a side surface of the holder 112 shown in FIG. 7.

Figure 12:
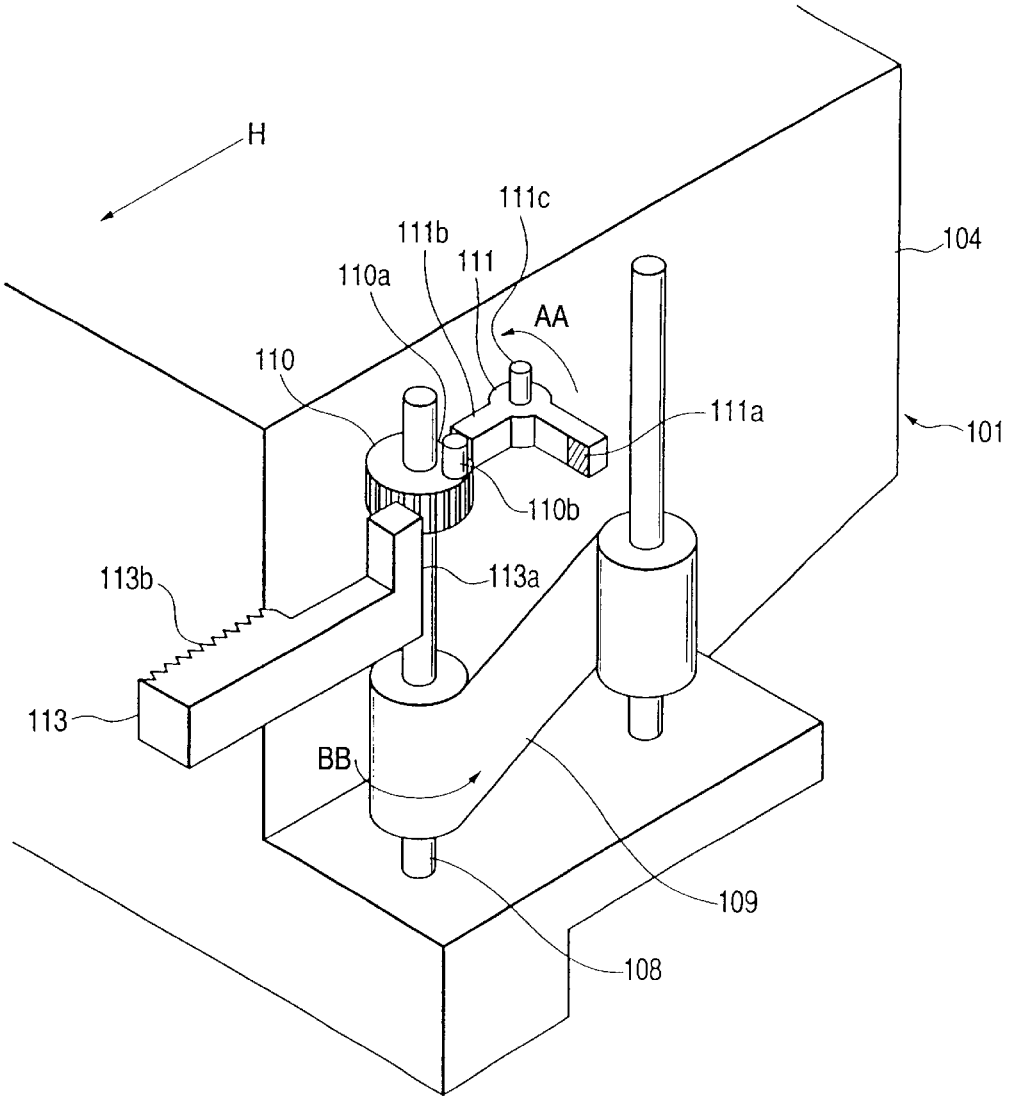
FIG. 12 is a perspective view showing the positional relationship between a gear and stopper of the process cartridge in FIG. 11 and a rack of the image forming apparatus.

FIG. 12 shows the relationship of position between the gear 110, the stopper 111, and the rack 113. When the process cartridge 101 is inserted in the direction H, an abutting portion 113*a* of the rack 113 abuts on the operative arm 111*a* of the stopper 111 to rotate the stopper 111 in the direction A to remove the stop arm 111*b* from a pin 110*b* of the gear 110, thereby releasing the stopper 111. When the process cartridge 101 is further inserted in the direction H, the gear 110 meshes with teeth 113*b* of the rack 113 to rotate the seal winding shaft 108 in the direction B to wind up an unsealing-start welded portion of the toner seal 107 (the range D in FIG. 9) in a manner peeling off the toner seal. When this pulling-start welded portion has been peeled off to wind up a corresponding portion of the toner seal 107, the gear 110 and the rack 113 are disengaged from each other and the winding based on the constant-load spring 109 is started. The rotation of the shaft 108 effected by the constant-load spring 109 causes the gear 110 to run idly. The stopper mechanism for stopping the rotation of the shaft 108 effected by the spring force of the constant-load spring 109 that is an elastic member is not limited to the provision of the stopper member, but the peeling force applied to the unsealing-start welded portion (the range D in FIG. 9) may be used as a stopper. In addition, by using a different combination of the rack and pinion and the stopper, the process cartridge can be prevented from misuse.

Embodiment 3

Figure 13:
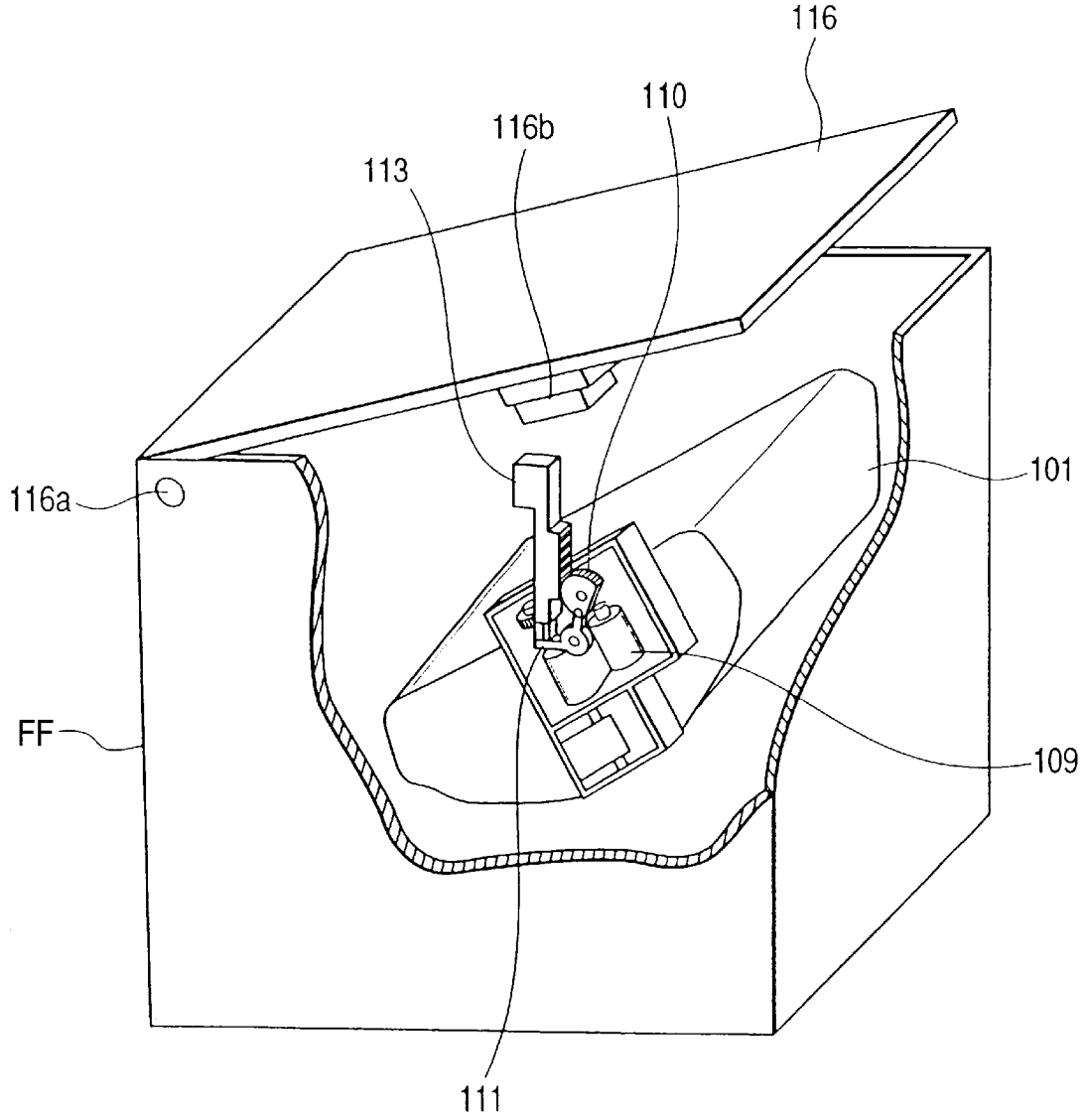
FIG. 13 is a perspective view of a configuration for winding an unsealing start portion of the toner seal by interlocking with a main-body cover.

FIG. 13 shows Embodiment 3 of an automatic toner-seal unsealing mechanism. FIG. 13 shows a case where a main-body cover 116 pivotally attached to the image-forming-apparatus main body F via a hinge 116*a* is opened and closed to rotate the gear 110. When the process cartridge 101 is inserted into the image-forming-apparatus main body F and the main-body cover 116 is closed, an abutting portion 116*b* of the main-body cover 116 presses the rack 113 mounted in the apparatus main body F for movement in the direction of a train of rack teeth, so that the rack 113 releases the stopper 111 while rotating the gear 110 to unseal the pulling start portion of the toner seal 107. When the main-body cover 116 has been closed completely, the gear 110 and the rack 113 are disengaged from each other, and unsealing is subsequently started due to the restoring force of the constant-load spring 109. A coil spring or the like is provided on a lower part of the rack 113 so that the rack 113 can be moved up and down in response to opening and closing of the main-body cover 116. Since after the unsealing, the gear is stopped at a position at which a notch 110*a* therein faces the rack 113 in order to prevent the gear 110 from meshing with the rack 113, the gear 110 is precluded from rotating each time the main-body cover 116 is opened or closed. By using the operations for opening and closing the main-body cover 116 as means for triggering pulling of the toner seal 107, the factors in the shakiness of the process cartridge during insertion can be reduced because unsealing is carried out after the process cartridge 101 has been positioned.

Embodiment 4

Figure 14:
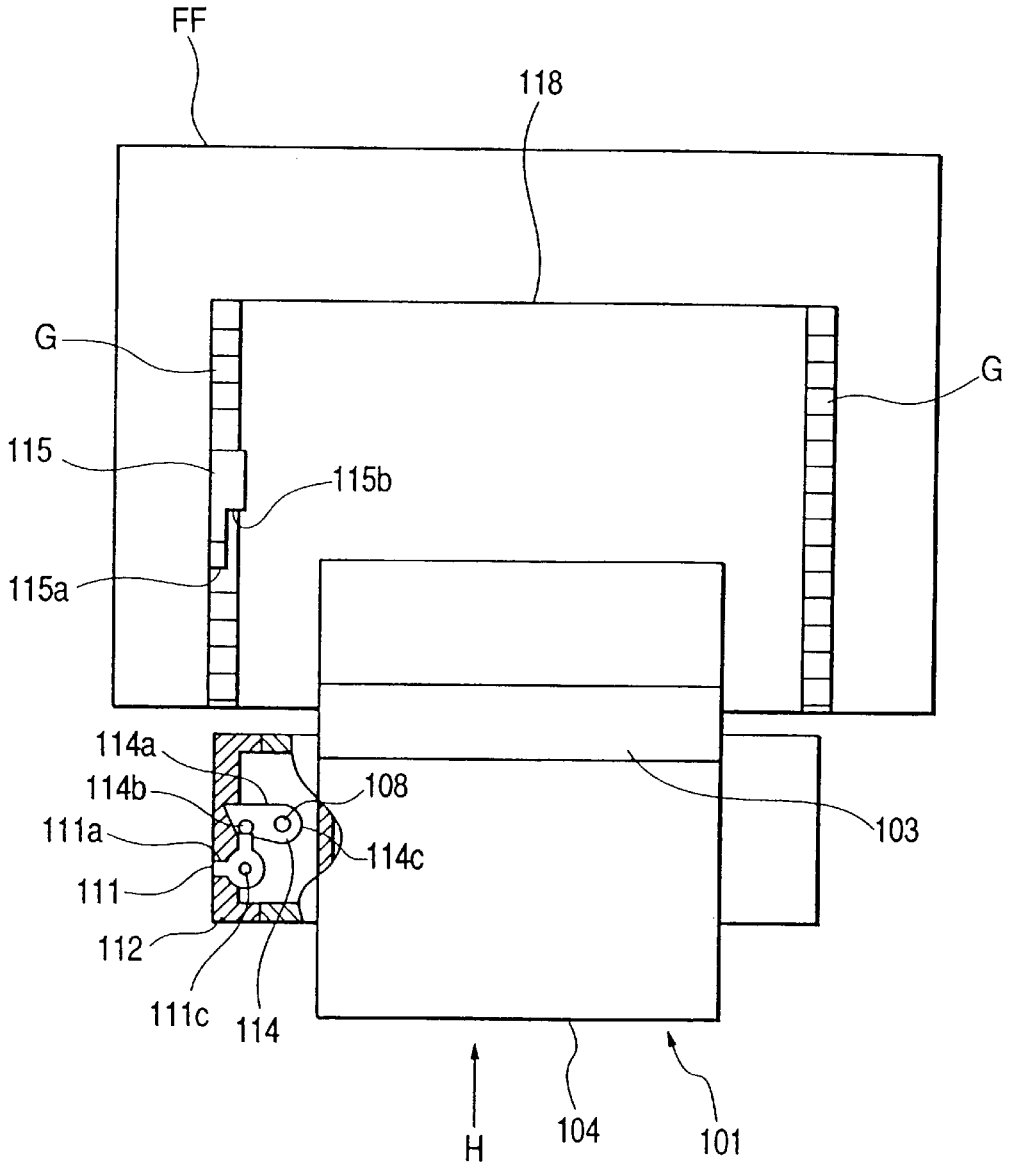
FIG. 14 is a plan view showing how a process cartridge configured to start unsealing the toner seal using a cam and a cam follower is installed in the image forming apparatus.
Figure 15:
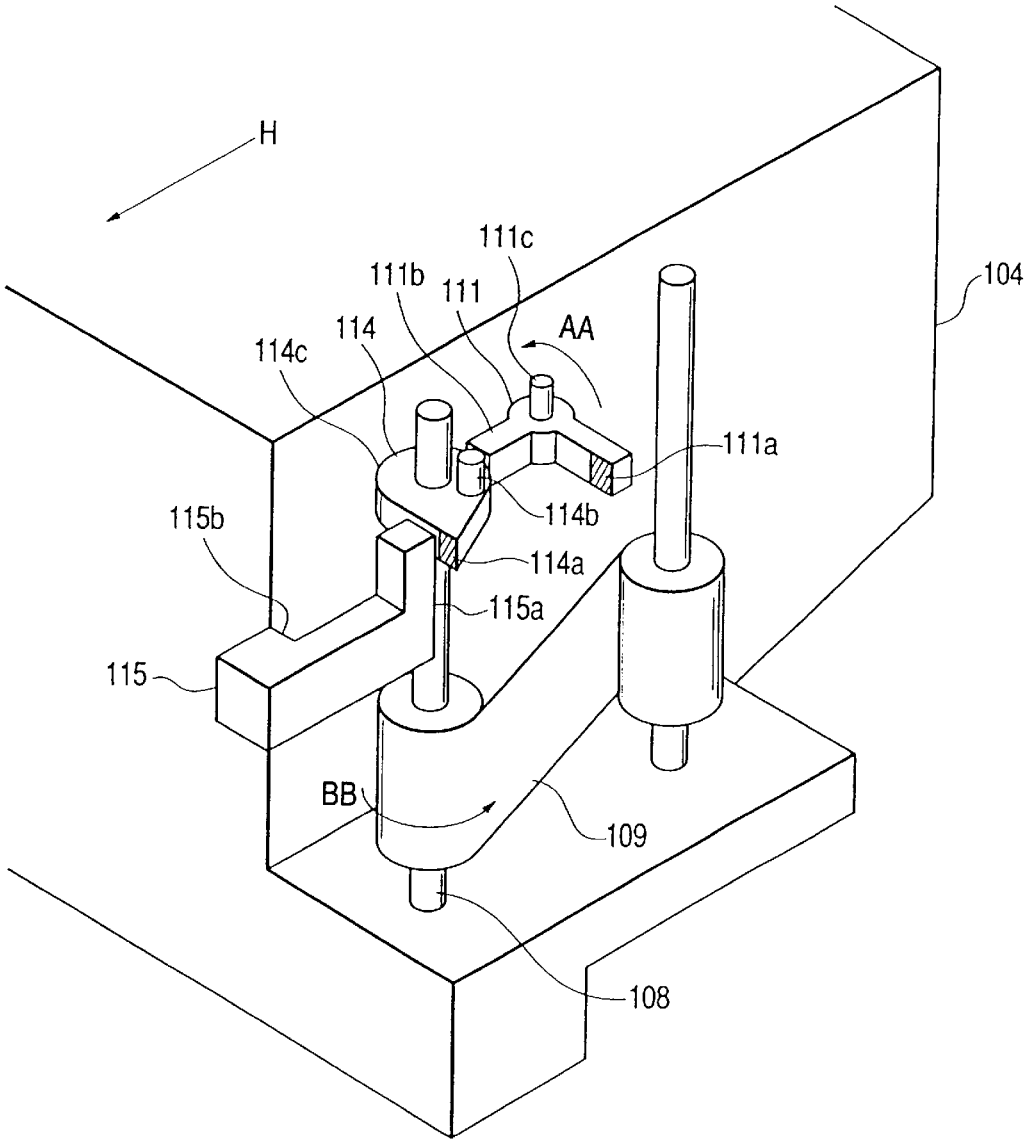
FIG. 15 is a perspective view showing the positional relationship between a gear and stopper of the process cartridge in FIG. 14 and a rack of the image forming apparatus.

FIGS. 14 and 15 show Embodiment 4 of an automatic toner-seal unsealing mechanism.

FIGS. 14 and 15 show the use of a cam 114 with a pin 114*b* and a cam follower (for use as an actuator) 115 fixedly installed in the apparatus main body F instead of the gear and rack in Embodiment 2. FIG. 14 is a top view showing how the process cartridge 101 is installed into the image-forming-apparatus main body F. As in the use of the rack and pinion, when the process cartridge 101 is inserted in the direction of arrow H, an abutting portion 115*a* of the cam follower 115 abuts on the operative arm 111*a* to remove a pin 114*b* from the stopper 111. The cam 114 then starts to rotate on abutting on the abutting portion 115*b* of the cam follower 115, thereby rotating the seal winding shaft 108 to wind up the pulling-start welded portion of the toner seal 107. The cam follower 115 passes through the cam 114, which can then rotate freely. Subsequently, the toner seal 107 is wound up because of the constant-load spring 109.

FIG. 15 shows the relationship between the stopper 111, the cam 114, and the cam follower 115. The cam 114 is attached to the winding shaft 108 in such a direction that the seal winding shaft 108 is rotated when a cam top side portion 114*a* is pushed. When the process cartridge is installed in the direction H, a tip 115*a* of the cam follower 115 abuts on the operative arm 111*a* of the stopper 111 to rotate the stopper 111 in the direction A so as to release it. When the process cartridge 101 is further inserted in the direction of the arrow H, the cam top side portion 114*a* of the cam 114 abuts on an abutting portion 115*b* of the cam follower 115 to rotate the seal winding shaft 108 in the direction B. After the cam 114 has rotated the shaft 108 to wind up a sufficient amount of the toner seal 107 to peel off the unsealing-start welded portion (the range D in FIG. 9) thereof, the seal winding shaft 108 is rotated because of the restoring force of the constant-load spring 109 to wind up the toner seal 107. After rotating the cam 114 by a sufficient amount to peel off the unsealing-start welded portion of the toner seal 107, the cam follower 115 passes through the cam 114 and then reaches a position at which the cam 114 is allowed to run idly by means of the constant-load spring 109. After the toner seal has been wound up, the cam 114 is stopped at a position at which it does not abut on the cam follower 115, whereby it does not affect the subsequent detachment/attachment of the process cartridge. That is, the cam stop side portion 114*a* rotates through about 180° (π rad) from the position in FIG. 15, so that a circular portion 114*c* is opposed to a corresponding side surface of the cam follower 115 in such a way as to be spaced therefrom. In this manner, the position of a winding end of the toner seal 107 is specified so that the circular portion 114*c* is opposed to the side surface of the cam follower 115. The use of the cam and the cam follower enables easer positioning than the use of the rack and pinion. In addition, a change in shape of the cam 114 enables the winding force to be regulated for the initial unsealing. By using a different combination of the cam and cam follower and the stopper 111, the process cartridge can be prevented from misuse.

According to this embodiment, the portion of the rack or cam follower that abuts on the stopper is provided integrally with the rack or cam follower, which is an operative member for releasing the stopper mechanism. However, the operative member having the abutting portion for releasing the stopper may be separate from the operative member for rotating the shaft 108 at the beginning of unsealing of the toner seal. seal.

If a biaxial reversely-wound constant-load spring is used as a drive source, the spring may come loose due to a large difference in the toner-seal unsealing force between the welded portions that are peeled off and the other tom-up portions.

Thus, the following embodiment provides an automatic toner seal unsealing mechanism using a constant-load spring wherein the toner-seal can be appropriately unsealed using the constant-load spring by providing conditions under which the spring is prevented from coming loose and reducing the difference in toner-seal unsealing strength.

Embodiment 5

This embodiment is a variant of the automatic toner-seal unsealing mechanism according to Embodiment 2 which is obtained by modifying part of this mechanism. Those components that are common to Embodiment 2 have the same reference numerals.

The cartridge installation means can be seen when a main-body cover 116 of the apparatus main body is opened around a hinge 116*a*, as shown in FIG. 16. Cartridge installation guide portions G are provided opposite to each other and to the right and left of a cartridge installation space in such a manner that their front side relative to the apparatus are lower than their rear side. These guide portions G operate as guides during insertion of the process cartridge 101. Bosses (not shown) projected from opposite longitudinal sides of the cartridge frame and ribs (not shown) following the bosses are guided on the guide portions G to insert the process cartridge 101, and the main-body cover 116 is then closed to install the process cartridge 101 in the image forming apparatus K. A pin 220 is fixedly installed near the cartridge installation space so as to operate on an automatic unsealing device for the process cartridge 101.

Figure 24:
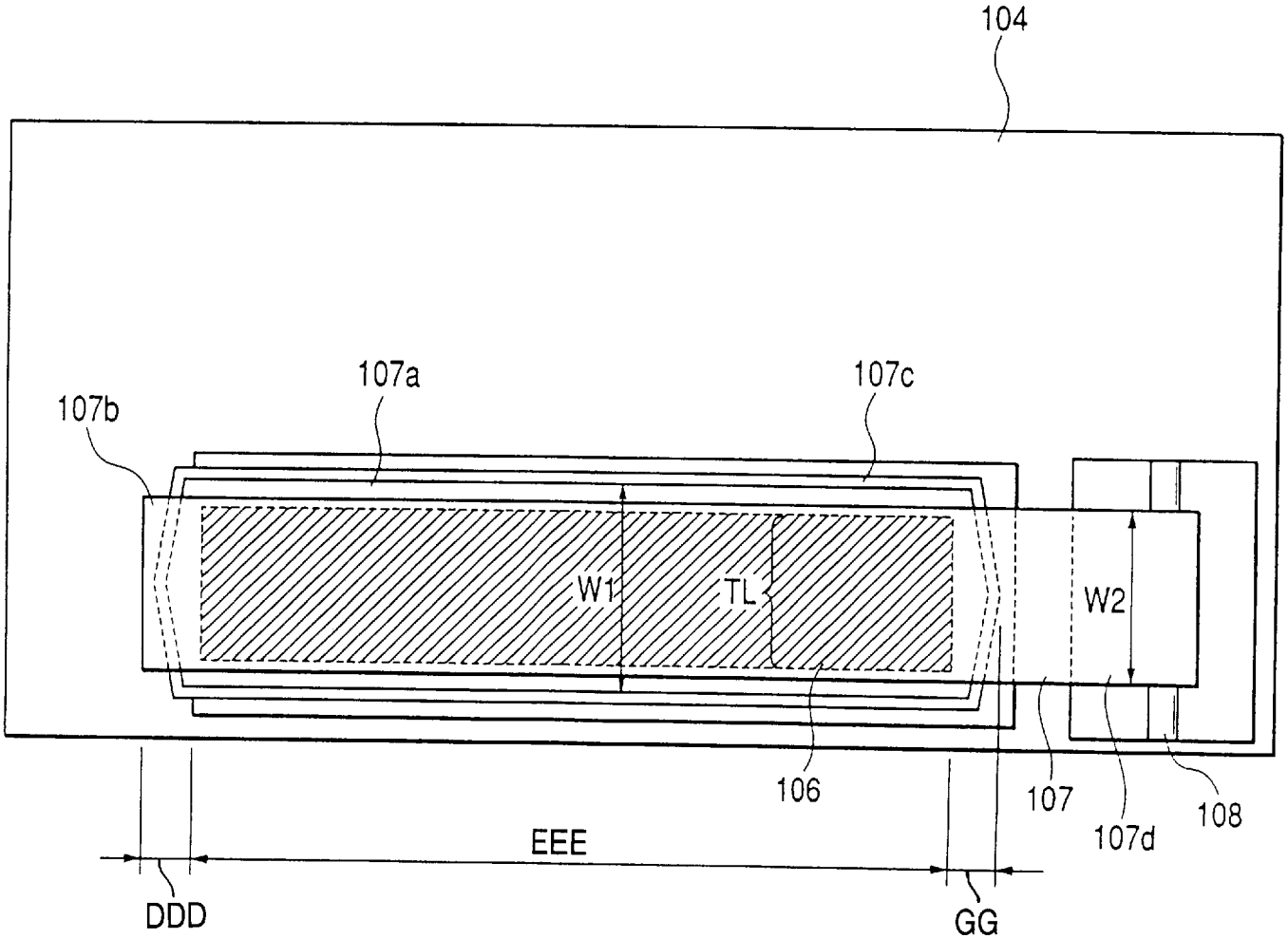
FIG. 24 is a front view of a toner seal.

FIG. 24 is a front view showing an opening 106 in a toner container 104. The opening 106 is sealed by the toner seal 107 and unsealed when the process cartridge 101 is first used. The toner seal 107 has a cover-seal portion 107*a* welded at its welded portion 107*c* to a corresponding edge of the opening 106 so as to cover and seal the opening 106; a folded-back portion 107*b* located on a side of the cover-seal portion 107*a* closer to the rear of the apparatus and at which the toner seal is folded back so as to overlap the cover-seal portion 107*a*; and a pullout portion 107*d* with its end fixed to the winding shaft 108.

The welded portion 107*c* has an intermediate portion EEE stuck to the longitudinally (a direction parallel with the photosensitive member drum) elongate rectangular opening 106 along its longitudinal edges, an unsealing start portion DDD in the form of the bottom of a ship that follows a folded-back-portion-107*b*-side end of the intermediate portion EEE, and an unsealing end portion GG in the form of the bottom of a ship that follows the other end of the intermediate portion EEE. The welded portion 107*c* surrounds the opening 106.

The width W2 of the pullout portion 107*d* of the toner seal 107 is smaller than the width W1 of the intermediate portion EEE of the welded portion 107*c*, and the cover-seal portion is located within the welded portion 107*c*. Consequently, by pulling the pullout portion 107*d* of the toner seal 107, the unsealing start portion DDD of the cover-seal portion 107*a* is peeled off and the cover-seal portion 107*a* is torn up along a torn-up line TL to move the folded-back portion 107*b* rightward in FIG. 24, thereby unsealing the toner seal.

Figure 17:
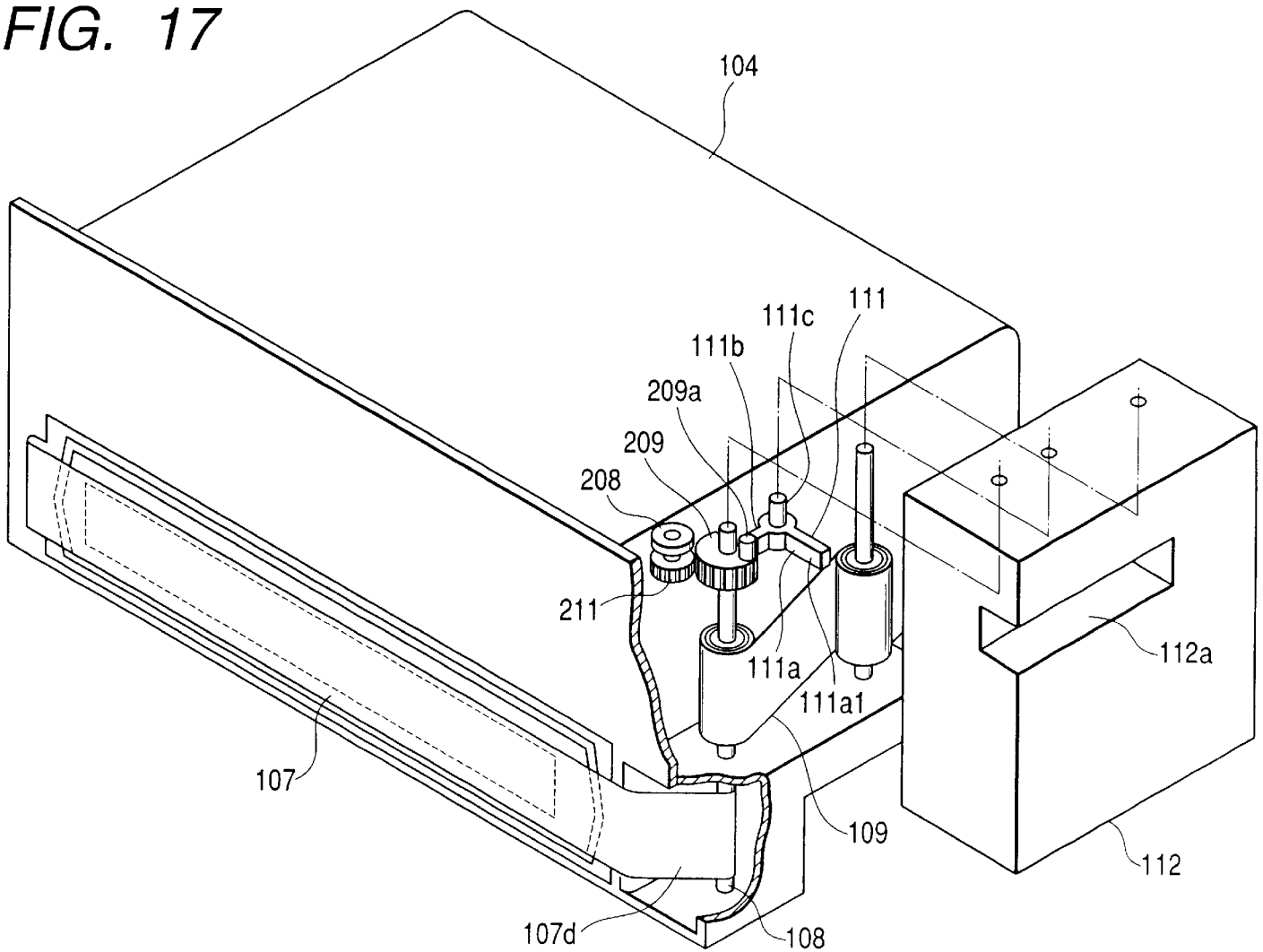
FIG. 17 is a perspective view of a toner-container section of a process cartridge showing an embodiment of the present invention.

FIG. 17 shows a perspective view of a toner container of a process cartridge comprising an automatic toner-seal unsealing mechanism based on a constant-load spring. In FIG. 17, the toner container 104 has both the seal winding shaft 108 and the constant-load spring 109, that is, a drive source provided at a side surface thereof, and the seal winding shaft 108 is rotatably supported by the toner container 104 or a cover (not shown) attached to the toner container. The seal winding shaft 108 has one end of the toner seal 107 fixed thereto by means of screwing, welding, or adhesion. In addition, one end of the constant-load spring 109 is also fixed to the seal winding shaft 108 by means of screwing, so that the toner seal 107 can be wound up by the rotation of the shaft effected by the restoring force of the constant-load spring 109. The constant-load spring 109 is wound up around the seal winding shaft 108 to generate a charge force, and the stopper 111 and a gear 209 are provided for holding the constant-load spring 109 in the charged state. The gear 209 is fixed to the winding shaft 108 so as to rotate therewith. In addition, the gear 209 has a projection 209*a*, with which the stopper 111 is brought in contact to hold the charged state. The stopper 111 has a bell crank 111*b* rotatably provided on a shaft 111*c*. The other end 111*b* of the bell crank 111*b* abuts on the projection 209*a* to stop the gear 209 from rotating. That is, the gear 209 is stopped from rotating because a tangent to a circle corresponding to a locus of motion of the center of the projection 209*a* passes through the center of a shaft 111*c* of the stopper 111. The constant-load spring 109, the stopper 111, and the gear 209 are accommodated inside the holder 112. The holder 112, which is fixed to a toner frame 104, rotatably supports one end of each of the winding shaft 108, the stopper shaft 111*c*, and the shaft of the constant-load spring 109. In addition, the holder 112 has a groove 112*a* formed in a side surface thereof. When the process cartridge 101 is installed in an image-forming-apparatus main body, a pin 220 in the image-forming-apparatus main body is inserted into the groove 112*a* and abuts on the bell crank 111*a*, one end 111*a* of which faces the groove 112*a*. Then, the bell crank 111*a* rotates and the other end 111*b* thereof slips out from the projection 209*a* to release the charged state. As a result, the spring force of the constant-load spring 109 causes the winding shaft 108 to rotate to unseal the toner seal 107. If the constant-load spring is of a biaxial reversely-wound type, a small size can be used compared to the required torque, whereas the spring may come loose without a certain amount of loads, thereby preventing winding from being completed.

Figure 19:
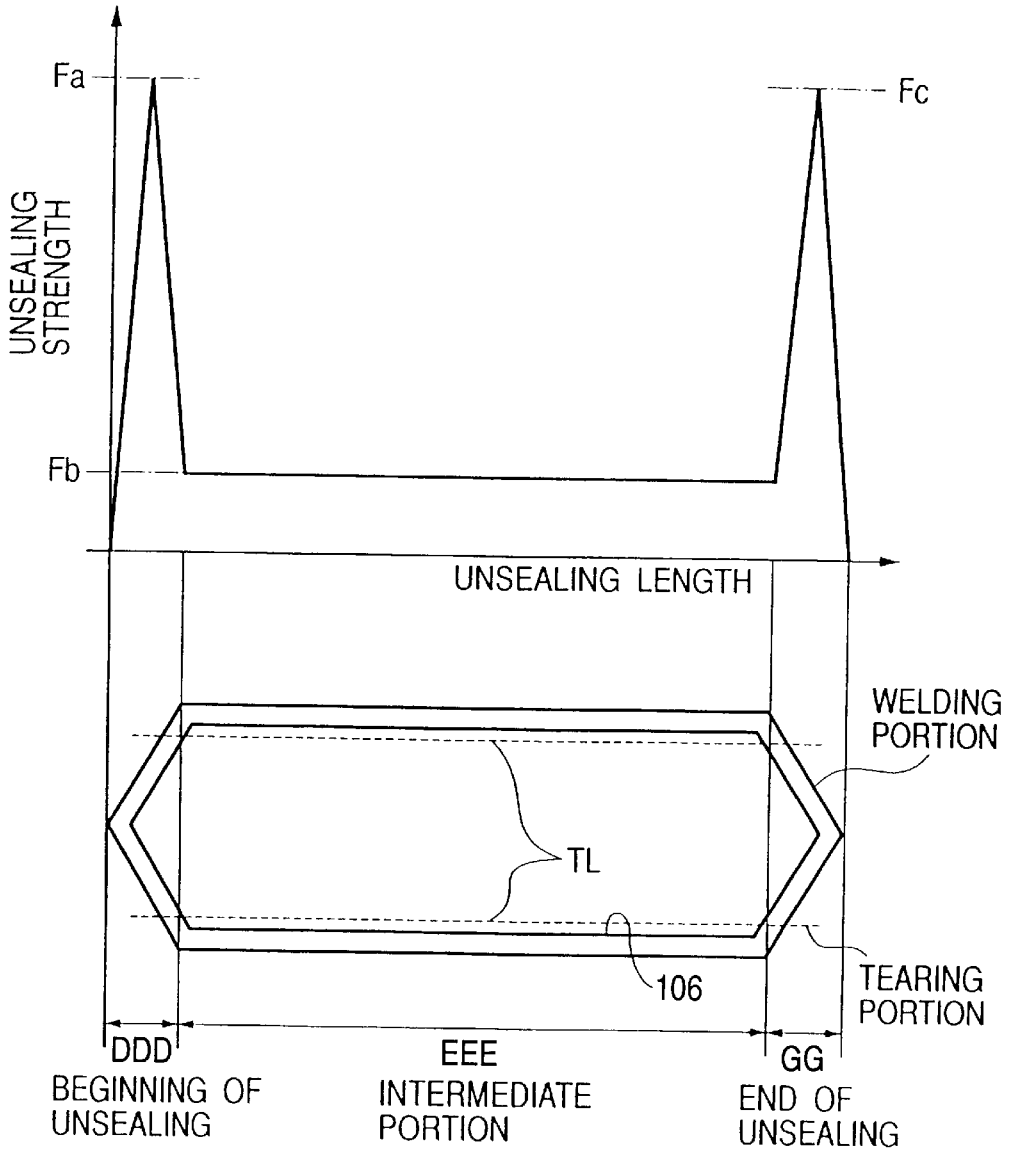
FIG. 19 shows a graph of the toner-seal unsealing strength and a corresponding pattern of a welded portion.

FIG. 19 shows a graph of the toner-seal unsealing strength and a corresponding pattern of the welded portion. The ordinate indicates the unsealing length, and the abscissa indicates a force applied in pulling the toner seal, that is, the unsealing strength. The force applied at the beginning of unsealing D is defined as Fa, the force applied in the intermediate portion E is defined as Fb, and the force applied at the end of unsealing G is defined as Fc. For Fa and Fc, the unsealing strength is large because of the need to peel off the welded portion. For Fb, the unsealing strength is small and steady because in this portion, the welded portion is not peeled off but the toner seal is torn up.

Figure 20:
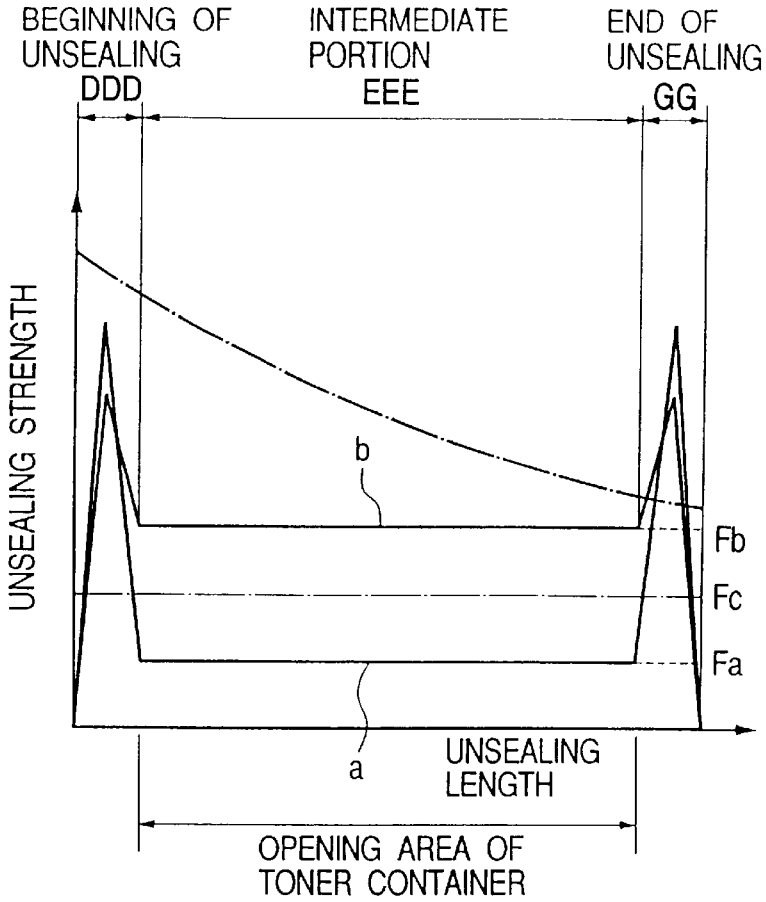
FIG. 20 is a graph of the toner-seal unsealing strength, a winding force applied by a spring, and a load required to prevent the spring from loosening.

FIG. 20 shows a graph of the toner-seal unsealing strength and the relationship between a winding force Fd applied by the spring and a load Fc required to preclude the spring from loosening. Since the diameter of the wound toner seal increases linearly with its thickness as unsealing progresses, the winding force Fd decreases with increasing unsealing length. If the unsealing strength required to prevent the spring from loosening is defined as Fc, the welded portion of the beginning of unsealing can be wound up if the unsealing strength is as shown at a in FIG. 20. In this case, however, the spring comes loose because the unsealing strength in the intermediate portion (hereafter referred to as the "intermediate unsealing strength") Fa is smaller than the required unsealing strength Fc. If the unsealing strength is as shown at b in FIG. 20, the intermediate portion can be completely unsealed because the intermediate unsealing strength Fb is larger than the required unsealing strength Fc, which prevents the spring from loosening. Complete unsealing of the intermediate portion allows the opening in the toner container to be entirely exposed, whereby no functional problem occurs without peeling off the unsealing-end welded portion.

Figure 21:
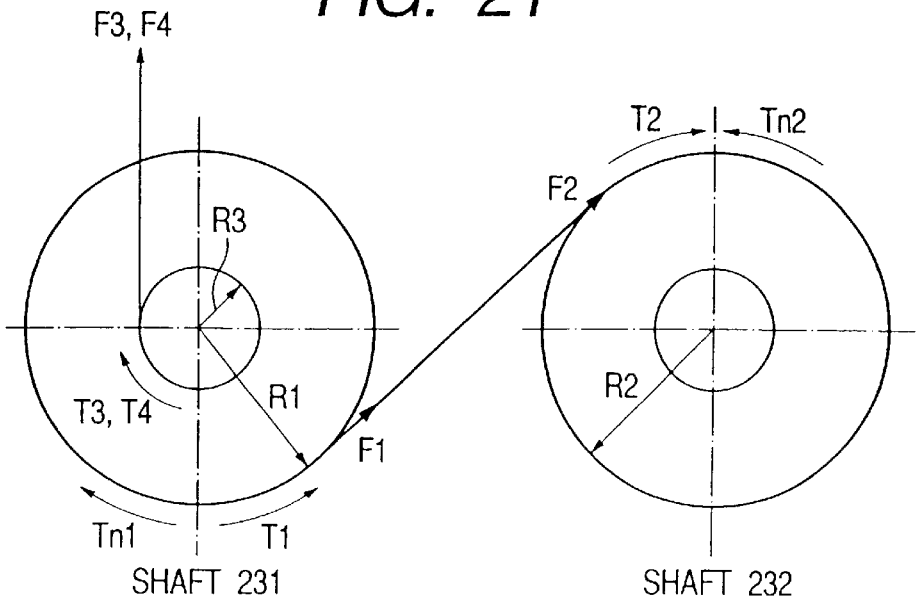
FIG. 21 shows a modeled constant-load spring.

FIG. 21 shows a modeled constant-load spring to indicate conditions under which the spring is prevented from loosening. The toner seal is wound up around a shaft 231, while the spring is wound up around a shaft 232. A force applied by the constant-load spring and a load F3 originating in the toner-seal unsealing strength act on the shaft 231, but a force F4 is intentionally applied to the shaft 231. Likewise, a restoring force F2 of the constant-load spring acts on the shaft 232. Torques effected around the shaft 231 by F1, F3, F4 are defined as T1, T3, T4, and a torque effected around the shaft 232 by F2 is defined as T2. In addition, if the radius of a portion of the shaft 231 around which the spring is wound beforehand is defined as R1, the radius of a portion of the shaft 231 around which the toner seal is wound up is defined as R3, and the radius of a portion of the shaft 232 around which the spring is wound up is defined as R2, then the following equations hold: $T1=F1\cdot R1$, $T2=F2\cdot R2$, $T3=F3\cdot R3$, $T4=F4\cdot R3$. When other load torques resulting from sliding friction or the like are defined as Tn1, Tn2, the spring does not come loose if $T1-T3-T4-Tn1<T2-Tn2$ because the spring is prevented from loosening if the torque acting on the shaft 231 is larger than that acting on the shaft 232. Accordingly, the intentionally applied load is determined to be $T4\geqq T1-T2-T3-Tn1+Tn2$ in terms of the torque around the shaft 231.

Figure 18:
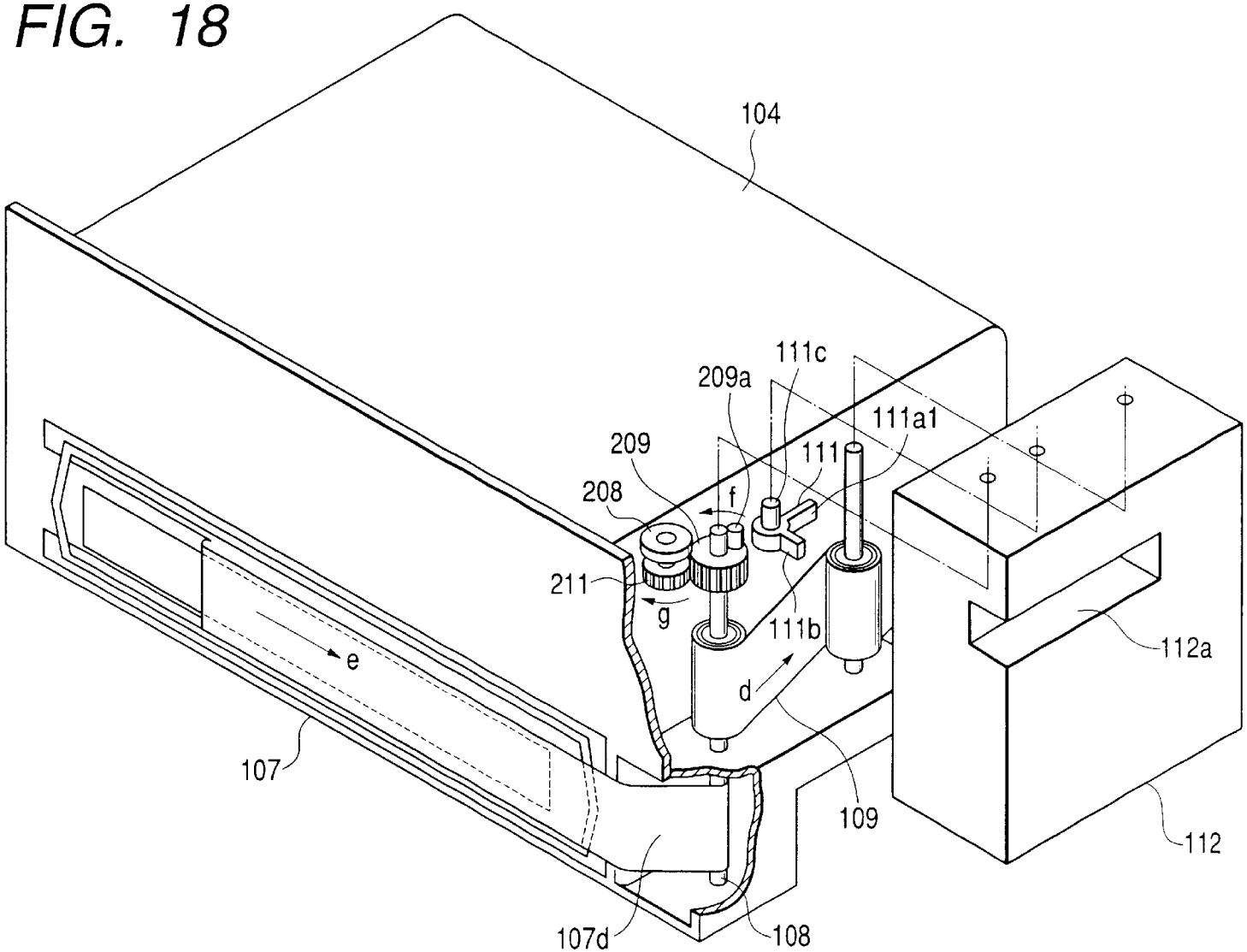
FIG. 18 is a perspective view of a toner-container section of a process cartridge showing an embodiment of the present invention.

Thus, according to this embodiment, an oil damper 208 is added to the toner-seal winding shaft 108 as a load to increase the intermediate unsealing strength Fb, as shown in FIGS. 17 and 18. In FIGS. 17 and 18, the oil damper 208 is driven by a rotatable gear 211 meshing with the gear 209 fixed to the winding shaft 108. When the stopper 111 is released, the constant-load spring 109 starts being wound up in the direction d in FIG. 18. Then, the seal winding shaft 108 starts to rotate to unseal the toner seal 107 in a direction e. The gear 209 provided around the seal winding shaft 108 rotates therewith in a direction f, and the gear 211 for the oil damper 208 rotates in a direction g while applying a load to the gear 209. Action for increasing the intermediate unsealing strength Fb corresponds to application of F4 in FIG. 21. In this manner, by using for the winding shaft 108 the oil damper 208 with a resistance force increasing in proportion to the rotation speed, the load on the winding shaft 108 corresponding to the intermediate unsealing strength Fb can be increased so as to reduce the difference between this load and the load on the winding shaft 108 based on the unsealing strength Fa at the beginning of unsealing.

Figure 22A:
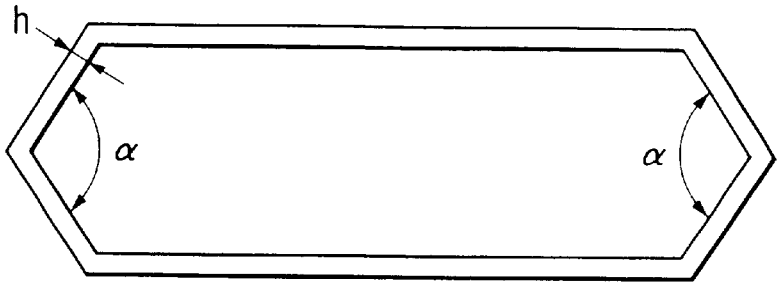
FIGS. 22A, 22B, and 22C each show a toner-seal welding pattern obtained if the angle of a welding tip portion or the welding width is varied.
Figure 22B:
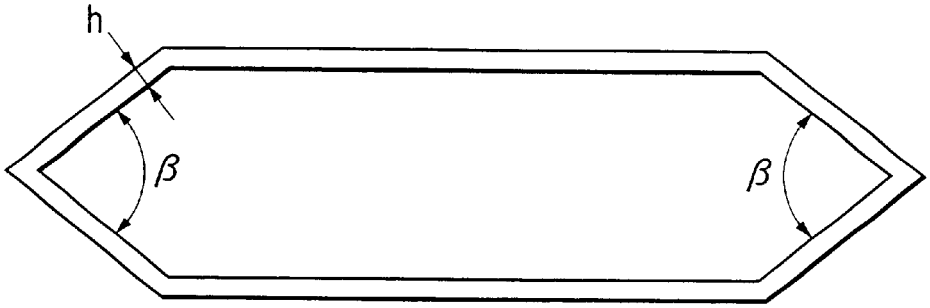
Figure 22C:
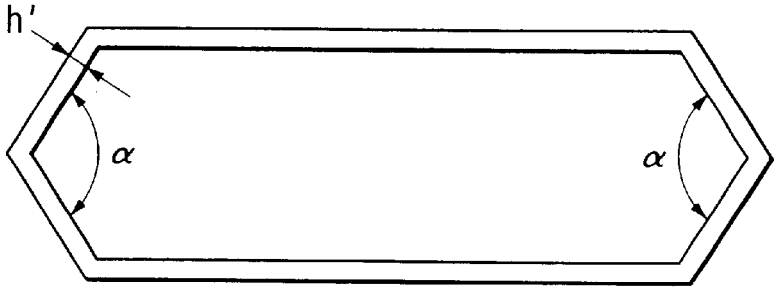
Figure 23:
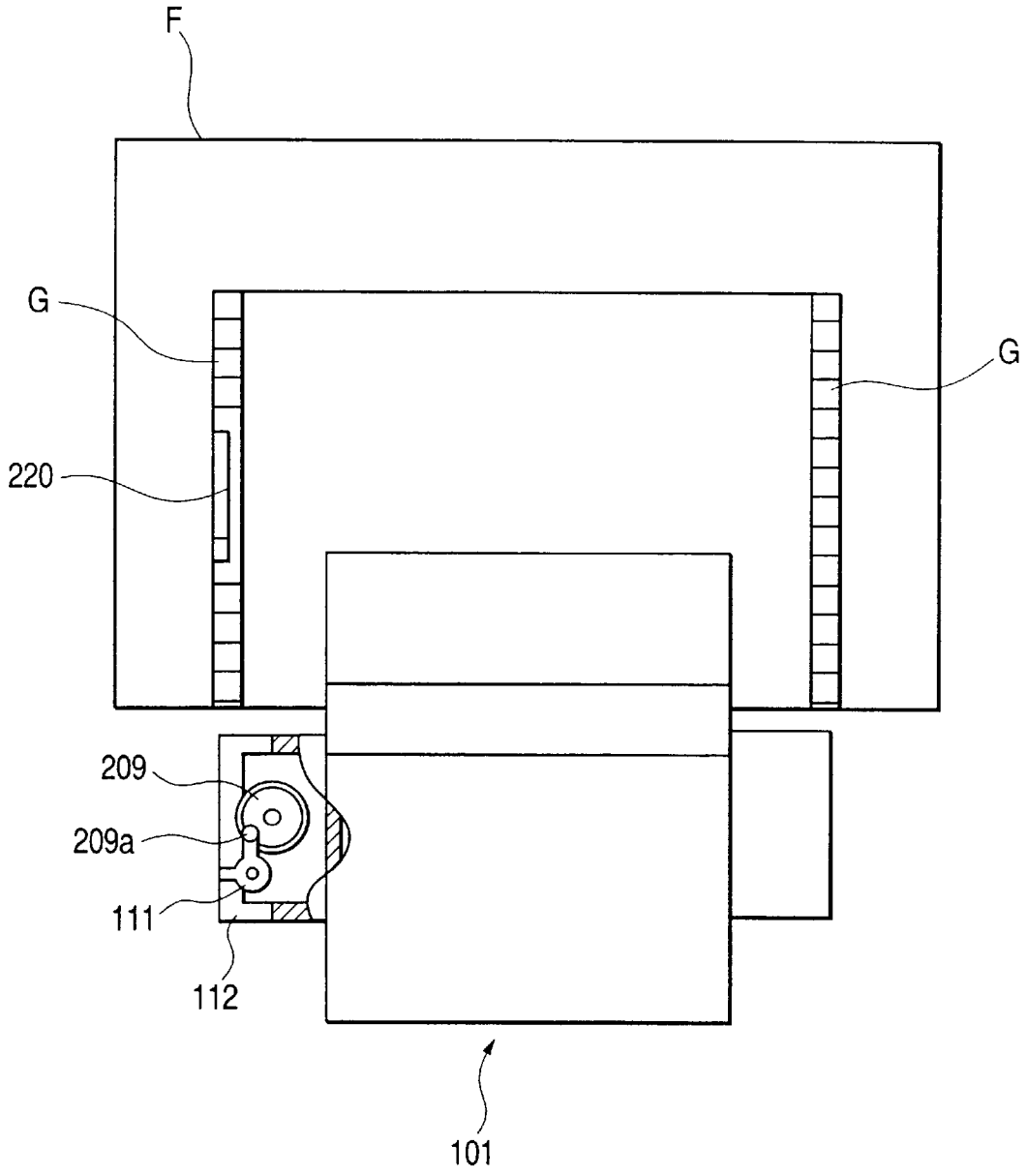
FIG. 23 is a plan view of a cartridge-installation portion of an image-forming-apparatus main body.

FIGS. 22A to 22C show examples of toner-seal welding patterns. In FIG. 22A, both a welding tip portion and a welding rear-end portion are in the form of the bottom of a ship, the welding angle at which the toner seal is stuck to the bottom of a ship is a, the welding width is h, and the unsealing strength Fa=Fa1. In FIG. 22B, the welding angle is $\beta$, the welding width is h, and the unsealing strength Fa=Fa2. Since $\alpha\geqq\beta$, the unsealing strength Fa of the welded portion is Fa1>Fa2. In addition, in FIG. 22C, the welding angle is $\alpha$ and the welding width is h'. Since $h\geqq h'$, the unsealing strength Fa of the welded portion is Fa1$\geqq$Fa3. Reducing Fa serves to reduce the size of the constant-load spring, thereby enabling the strength of the shaft to be reduced.

Since the difference between Fa and Fb can be reduced by increasing the intermediate unsealing strength Fb while reducing the unsealing strength Fa at the beginning of unsealing, a required load is preferably applied to the toner seal winding shaft 108 by reducing Fa as much as possible and designing the spring 109 depending on the resulting strength value.

Specific examples of the angles $\alpha$, $\beta$ and the welding widths h, h' are shown below:

Conventional angle $\alpha$=about 145° ($140\times\pi/180\approx0.78$ $\pi$rad), conventional h=about 3 mm Present angle $\alpha$=about 90° (0.5 $\pi$rad), present h'=about 2 mm.

Other Embodiments

Although the process cartridges shown in the above embodiments are used to form monochromatic images, the cartridge according to the present invention is applicable not only to formation of monochromatic images but also to cartridges, provided with a plurality of developing means, for forming images in a plurality of colors (for example, bicolor, tricolor, or full-color images).

In addition, the present invention may use various developing methods such as the well-known two-component magnetic-brush developing method, the cascade-developing method, the touch-down developing method, and the cloud-developing method.

Further, the electrophotographic photosensitive member is not limited to the above photosensitive-member drum, but includes, for example, the following: First, the photosensitive member comprises a photoconductor including, for example, amorphous silicon, amorphous selenium, zinc oxide, titanium oxide, and an organic photoconductor (OPC). The shape for mounting the photosensitive member includes, for example, a drum-shaped or belt-shaped rotor and a sheet. In general, a drum-shaped or belt-shaped rotor is used, and a drum-type photosensitive member is obtained by depositing or coating a photoconductor on a cylinder such as an aluminum alloy.

In addition, although the above embodiments use a so-called contact charging method as charging means, of course another conventional configuration may be used in which the surface of a photosensitive member drum is uniformly charged by providing metallic shields of aluminum or the like around a tungsten wire at three sides thereof, applying a high voltage to the tungsten wire, and moving the resulting positive or negative ions to the surface of the drum.

In addition to the above roller type, the charging means may be of a blade (charging blade), a pad, a block, a rod, or a wire type.

Further, the cleaning means for use in cleaning a residual toner on the photosensitive member drum may comprise a fur brush or a magnetic brush instead of the above cleaning blade.

In addition, the above-described process cartridge comprises, for example, an electrophotographic photosensitive member and at least one process means. Thus, in addition to the above embodiments, the aspects of the process cartridge include, for example, one comprising an electrophotographic photosensitive member, developing means, charging means integrated into a cartridge that is detachably attachable to the image-forming-apparatus main body, one comprising an electrophotographic photosensitive member and developing means integrated into a cartridge that is detachably attachable to the image-forming-apparatus main body, and one comprising an electrophotographic photosensitive member, developing means, and cleaning means integrated into a cartridge that is detachably attachable to the apparatus main body.

That is, the above-described process cartridge comprises at least one of charging means and cleaning means, an electrophotographic photosensitive member, and developing means integrated into a cartridge that is detachably attachable to the apparatus main body. Furthermore, it may comprise at least developing means and an electrophotographic photosensitive member integrated into a cartridge that is detachably attachable to the image forming apparatus main body. This process cartridge may be detachably attachable to the apparatus main body by the user. Thus, the user can perform maintenance work for the apparatus main body.

Furthermore, although the above embodiments illustrate the laser beam printer as an electrophotographic image forming apparatus, the present invention need not be limited to this aspect, but is of course applicable to other electrophotographic image forming apparatuses such as electrophotographic copiers, facsimile terminal equipment, or word processors.

Although in the above embodiments, the developer container is contained in part of the process cartridge and is detachably attachable to the image forming apparatus main body, the developer container may solely be detachably attachable to the image-forming-apparatus main body.

In addition, a developing device comprising a developing container and a developer container may be provided as a developing cartridge that is detachably attachable to the image-forming-apparatus main body.

What is claimed is:

1. A developer container comprising:

a container main body including an opening through which a developer is supplied;

a seal member for unsealably sealing said opening; and a drive source for applying a force for unsealing said seal member, said drive source including an elastic member and said drive source applying said unsealing force using a restoring force of the elastic member, wherein said elastic member is a constant-load spring.

2. The developer container according to claim 1, wherein said elastic member is a spiral spring.

3. The developer container according to claim 1, wherein said developer container has a rotatable winding member for winding up said seal member to unseal said seal member, and wherein said drive source applies the unsealing force to said seal member via said winding member.

4. The developer container according to claim 3, wherein said seal member wound up by said winding member is contained inside said container main body.

5. The developer container according to claim 3, wherein a winding portion of said winding member is contained inside said container main body.

6. The developer container according to claim 1, further comprising holding means holding in a state where the restoring force of said elastic member for applying the unsealing force unsealing said seal member is stored.

7. The developer container according to claim 6, wherein when said developer container is installed in an image forming apparatus main body, a releasing member provided in said apparatus main body releases the holding of said holding means in the state where said restoring force is stored.

8. The developer container according to claim 7, wherein said releasing member is a projection abutting on said holding means.

9. The developer container according to claim 7, wherein interlocked with an operation for installing said developer container in said image forming apparatus main body, said releasing member releases the holding of said holding means in the state where said restoring force is stored.

10. The developer container according to claim 1, further comprising a driving force receiving portion for receiving a driving force unsealing said seal member, from an operative member provided in an image forming apparatus main body, when said developer container is installed in said image forming apparatus main body and unsealing of said seal member is started.

11. The developer container according to claim 10, wherein said driving force receiving portion receives the driving force unsealing said seal member, from said operative member, from the start of unsealing of said seal member until before the unsealing is complete.

12. The developer container according to claim 10, wherein interlocked with an operation for installing said developer container in said image forming apparatus main body, said driving force receiving portion receives the driving force unsealing said seal member from said operative member.

13. The developer container according to claim 10, wherein interlocked with an operation for closing a main body cover provided in said image forming apparatus main body, said driving force receiving portion receives the driving force unsealing said seal member from said operative member.

14. The developer container according to claim 10, wherein said operative member is a rack, and said driving force receiving portion is a gear meshing with said rack.

15. The developer container according to claim 10, wherein said operative member is a cam follower, and said driving force receiving portion is a cam engaging with said cam follower.

16. The developer container according to claim 1, further comprising a reduction means for reducing the difference between a load applied to said constant-load spring at the start of unsealing of said seal member and a load subsequently applied in unsealing an intermediate portion of said seal member.

17. The developer container according to claim 16, wherein said reduction means includes load applying means for applying a load to said constant-load spring separately from the force for unsealing said seal member when unsealing said intermediate portion of said seal member.

18. The developer container according to claim 17, further comprising a rotatable winding member for winding up said seal member to unseal said seal member, wherein said drive source applies the unsealing force to said seal member via said winding member, and said load applying means applies a load to said winding member.

19. The developer container according to claim 17, wherein the greater a speed at which said seal member is unsealed is, the greater said load applied by said load applying means.

20. The developer container according to claim 19, wherein said load applying means is a damper.

21. The developer container according to claim 19, wherein said load applying means is an oil damper.

22. A developer container comprising:

a container main body including an opening through which a developer is supplied;

a seal member for unsealably sealing said opening;

a drive source for applying a force for unsealing said seal member, said drive source including an elastic member and said drive source applying said unsealing force using a restoring force of the elastic member; and holding means holding in a state where the restoring force of said elastic member for applying the unsealing force unsealing said seal member is stored, wherein when said developer container is installed in an image forming apparatus main body, a releasing member provided in said apparatus main body releases the holding of said holding means in the state where said restoring force is stored, and wherein interlocked with an operation for closing a main body cover provided in said apparatus main body, said releasing member releases the holding of said holding means in the state where said restoring force is stored.

23. A developer container comprising:

a container main body including an opening through which a developer is supplied;

a seal member for unsealably sealing said opening;

a drive source for applying a force for unsealing said seal member, said drive source including an elastic member and said drive source applying said unsealing force using a restoring force of the elastic member;

holding means holding in a state where the restoring force of said elastic member for applying the unsealing force unsealing said seal member is stored; and support means provided outside said container main body to support said holding means, wherein said holding means is covered by said support means.

24. A cartridge detachably attachable to an image forming apparatus main body comprising:

a developer bearing member for bearing a developer to develop an electrostatic image formed on an image bearing member with the developer;

a developer container for supplying the developer toward said developer bearing member, said developer container including a container main body having an opening through which the developer is supplied and a seal member for unsealably sealing said opening; and a drive source for applying a force for unsealing said seal member, said drive source including an elastic member to apply said unsealing force using a restoring force of said elastic member, wherein said elastic member is a constant-load spring.

25. The cartridge according to claim 24, wherein said elastic member is a spiral spring.

26. The cartridge according to claim 24, wherein said cartridge has a rotatable winding member for winding up said seal member to unseal said seal member, and said drive source applies the unsealing force to said seal member via said winding member.

27. The cartridge according to claim 26, wherein said seal member wound up by said winding member is contained inside said container main body.

28. The cartridge according to claim 26, wherein a winding portion of said winding member is contained inside said container main body.

29. The cartridge according to claim 24, wherein said cartridge has holding means holding in a state where the restoring force of said elastic member for applying the unsealing force unsealing said seal member is stored.

30. The cartridge according to claim 29, wherein when said developer container is installed in said image forming apparatus main body, a releasing member provided in said apparatus main body releases the holding of said holding means in the state where said restoring force is stored.

31. The cartridge according to claim 30, wherein said releasing member is a projection abutting on said holding means.

32. The cartridge according to claim 30, wherein interlocked with an operation for installing said cartridge in said image forming apparatus main body, said releasing member releases the holding of said holding means in the state where said restoring force is stored.

33. The cartridge according to claim 24, wherein said cartridge includes a driving force receiving portion for receiving a driving force unsealing said seal member, from an operative member provided in said image forming apparatus main body, when unsealing of said seal member is started.

34. The cartridge according to claim 33, wherein said driving force receiving portion receives the driving force unsealing said seal member, from said operative member, from the start of unsealing of said seal member until before the unsealing is complete.

35. The cartridge according to claim 33, wherein interlocked with the operation for installing said cartridge in said image forming apparatus main body, said driving force receiving portion receives the driving force unsealing said seal member from said operative member.

36. The cartridge according to claim 33, wherein interlocked with an operation for closing a main body cover provided in said image forming apparatus main body, said driving force receiving portion receives the driving force unsealing said seal member from said operative member.

37. The cartridge according to claim 33, wherein said operative member is a rack, and said driving force receiving portion is a gear meshing with said rack.

38. The cartridge according to claim 33, wherein said operative member is a cam follower, and wherein said driving force receiving portion is a cam engaging with said cam follower.

39. The cartridge according to claim 24, wherein said cartridge includes a reduction means for reducing the difference between a load applied to said constant-load spring at the start of unsealing of said seal member and a load subsequently applied in unsealing an intermediate portion of said seal member.

40. The cartridge according to claim 39, wherein said reduction means has load applying means for applying a load to said constant-load spring separately from the force for unsealing said seal member when unsealing said intermediate portion of said seal member.

41. The cartridge according to claim 40, wherein said cartridge has a rotatable winding member for winding up said seal member to unseal said seal member, said drive source applies the unsealing force to said seal member via said winding member, and said load applying means applies a load to said winding member.

42. The cartridge according to claim 40, wherein the greater a speed at which said seal member is unsealed, the greater said load applied by said load applying means.

43. The cartridge according to claim 42, wherein said load applying means is a damper.

44. The cartridge according to claim 42, wherein said load applying means is an oil damper.

45. A cartridge detachably attachable to an image forming apparatus main body comprising:

a developer bearing member for bearing a developer to develop an electrostatic image formed on an image bearing member with the developer;

a developer container for supplying the developer toward said developer bearing member, said developer container including a container main body having an opening through which the developer is supplied and a seal member for unsealably sealing said opening; and a drive source for applying a force for unsealing said seal member, said drive source including an elastic member to apply said unsealing force using a restoring force of said elastic member, wherein said developer container has holding means holding in a state where the restoring force of said elastic member for applying the unsealing force unsealing said seal member is stored, wherein when said developer container is installed in an image forming apparatus main body, a releasing member provided in said apparatus main body releases the holding of said holding means in the state where said restoring force is stored, and wherein interlocked with an operation for closing a main body cover provided in said apparatus main body, said releasing member releases the holding of said holding means in the state where said restoring force is stored.

46. A cartridge detachably attachable to an image forming apparatus main body comprising:

a developer bearing member for bearing a developer to develop an electrostatic image formed on an image bearing member with the developer;

a developer container for supplying the developer toward said developer bearing member, said developer container including a container main body having an opening through which the developer is supplied and a seal member for unsealably sealing said opening; and a drive source for applying a force for unsealing said seal member, said drive source including an elastic member to apply said unsealing force using a restoring force of said elastic member, wherein said developer container has holding means holding in a state where the restoring force of said elastic member for applying the unsealing force unsealing said seal member is stored, wherein said cartridge includes support means provided outside said container main body to support said holding means, and said holding means is covered by said support means.

47. The cartridge according to any one of claims 24 to 44, further comprising said image bearing member.

48. The cartridge according to claim 47, wherein said image bearing member is a photosensitive member.

* * * * *

UNITED STATES PATENT AND TRADEMARK OFFICE

CERTIFICATE OF CORRECTION

PATENT NO. : 6,334,035 B1
DATED : December 25, 2001
INVENTOR(S) : Daisuke Abe et al.

It is certified that error appears in the above-identified patent and that said Letters Patent is hereby corrected as shown below:

Title page,
Item [56], References Cited, U.S. PATENT DOCUMENTS, "5,940,658 8/1999 Yokoi" should read -- 5,940,658 8/1999 Yokoi et al. --.

Column 7,
Line 61, "[m])," should read -- [mm], --.

Column 8,
Line 34, "blowcut" should read -- blowout --.

Column 9,
Line 46, "to" should read -- to be --.

Column 10,
Line 60, "in he" should read -- in the --.

Column 13,
Line 10, "easer" should read -- easier --.
Line 22, "seal. seal." should read -- seal. --.
Line 26, "tom-up" should read -- torn-up --.

Column 16,
Line 38, "3mm" should read -- 3mm. --.

Signed and Sealed this

Fifth Day of November, 2002

*Attest:*

*Attesting Officer*

JAMES E. ROGAN
*Director of the United States Patent and Trademark Office*